US006565201B1

(12) United States Patent
Jones

(10) Patent No.: US 6,565,201 B1
(45) Date of Patent: May 20, 2003

(54) LOAD AND FEED APPARATUS FOR SOLID INK

(75) Inventor: Brent R. Jones, Tualatin, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/159,898

(22) Filed: May 30, 2002

(51) Int. Cl.[7] ..... B41J 2/175; B41J 2/01

(52) U.S. Cl. ..... 347/88; 347/99; 347/84; 347/86

(58) Field of Search ..... 347/88, 99, 84, 347/86, 95; 242/375; 267/272, 73, 69; 185/45

(56) References Cited

U.S. PATENT DOCUMENTS 4,730,783 A * 3/1988 Lamson ..... 242/375
5,734,402 A 3/1998 Rousseau et al. ..... 347/88
5,861,903 A * 1/1999 Crawford et al. ..... 347/88
6,056,394 A 5/2000 Rousseau et al. ..... 347/88
6,170,942 B1 * 1/2001 Ogawa et al. ..... 347/88

* cited by examiner

*Primary Examiner*—Raquel Yvette Gordon
*Assistant Examiner*—M Shah
(74) *Attorney, Agent, or Firm*—Joseph M. Young

(57) ABSTRACT

A solid ink loader for feeding solid ink sticks in a phase change ink jet printer, which includes a feed chute with at least one feed channel for receiving at least one ink stick, a push block having at least one push block wall located inside the at least one feed channel, and a hub having at least one internal hub wall. The at least one internal hub wall is situated concentric with the at least one push block wall, and the hub can rotate substantially freely relative to the push block. A damping fluid is located between the at least one internal hub wall and the at least one push block wall for substantially increasing the friction between the hub and the push block.

20 Claims, 30 Drawing Sheets

LOAD AND FEED APPARATUS FOR SOLID INK

Reference is made to commonly-assigned copending U.S. patent application Ser. No. 10/159,929, filed May 30, 2002, by Jones, et al, and U.S. patent application Ser. Nos. 10/159,437, 10/159,884, 10/159,877, 10/159,883, 10/159,424, 10/159,902, 10/159,358, and 10/159,931, 10/159,674, filed May 30, 2002, by Jones, all of which are entitled: LOAD AND FEED APPARATUS FOR SOLID INK, the disclosures of which are incorporated herein.

BACKGROUND AND SUMMARY

Solid ink jet printers were first offered commercially in the mid-1980's. One of the first such printers was offered by Howtek Inc. which used pellets of colored cyan, yellow, magenta and black ink that were fed into shape coded openings. These openings fed generally vertically into the heater assembly of the printer where they were melted into a liquid state for jetting onto the receiving medium. The pellets were fed generally vertically downwardly, using gravity feed, into the printer. These pellets were elongated and tapered on their ends with separate rounded, five, six, and seven sided shapes each corresponding to a particular color.

Later solid ink printers, such as the Tektronix Phaser™, the Tektronix Phaser™ 300, and the Jolt printer offered by Dataproducts Corporation, used differently shaped solid ink sticks that were either gravity fed or spring loaded into a feed channel and pressed against a heater plate to melt the solid ink into its liquid form. These ink sticks were shape coded and of a generally small size. One system used an ink stick loading system that initially fed the ink sticks into a preload chamber and then loaded the sticks into a load chamber by the action of a transfer lever. Earlier solid or hot melt ink systems used a flexible web of hot melt ink that is incrementally unwound and advanced to a heater location or vibratory delivery of particulate hot melt ink to the melt chamber.

Basic configurations of a four-color ink loader having independent melt plates have been described in previously issued patents such as, for example, U.S. Pat. Nos. 5,734,402, 5,861,903, and 6,056,394. The disclosures of these patents are hereby incorporated by reference in their entirety.

Embodiments include a solid ink loader for feeding solid ink sticks in a phase change ink jet printer, which includes a feed chute with at least one feed channel for receiving at least one ink stick, a push block having at least one push block wall located inside the at least one feed channel, and a hub having at least one internal hub wall. The at least one internal hub wall is situated concentric with the at least one push block wall, and the hub can rotate substantially freely relative to the push block. A damping fluid is located between the at least one internal hub wall and the at least one push block wall for substantially increasing the friction between the hub and the push block.

BRIEF DESCRIPTION OF THE DRAWINGS

The invention will be described in detail herein with reference to the following figures in which like reference numerals denote like elements and wherein.

DETAILED DESCRIPTION OF EMBODIMENTS

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

Figure 1:
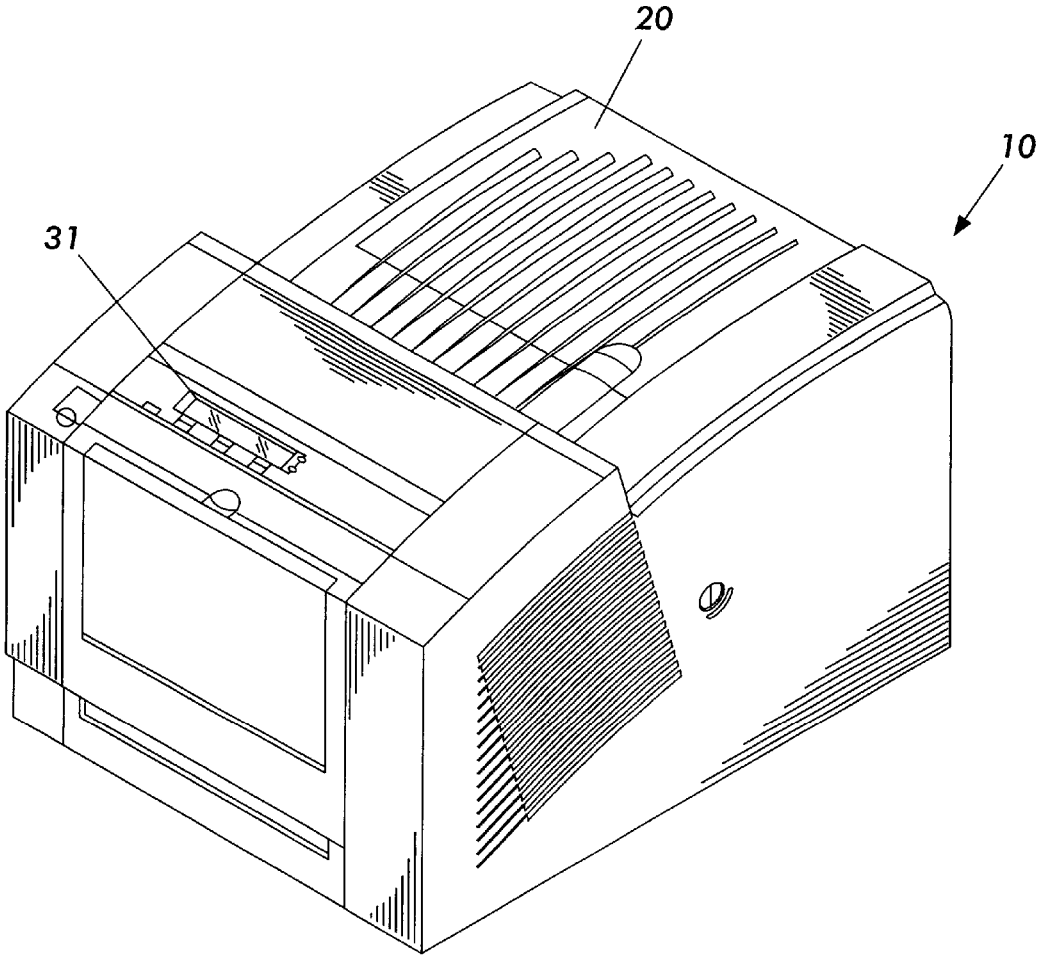
FIG. 1 is a perspective view of an exemplary embodiment of a color printer with the printer top cover closed.
Figure 2A:
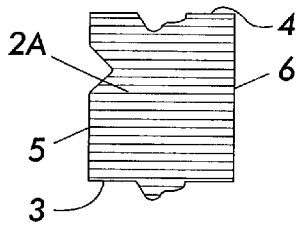
FIG. 2 illustrates a top view of an exemplary embodiment of a set of ink sticks.
Figure 2B:
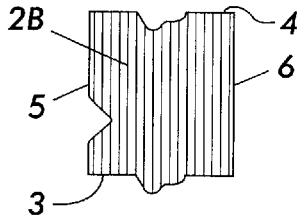
Figure 2C:
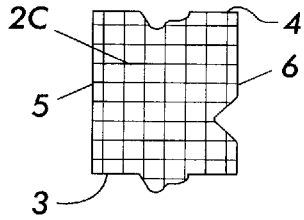
Figure 2D:
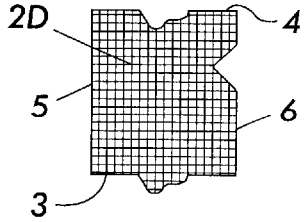

FIG. 1 discloses an embodiment of a solid ink or phase change printer 10 having an ink access cover 20. The ink access cover 20 is shown in a closed position in FIG. 1. Front panel display screen 31 can display messages concerning the status of the printer. These messages can include, for example, "ink low" or "ink empty."

Figure 3:
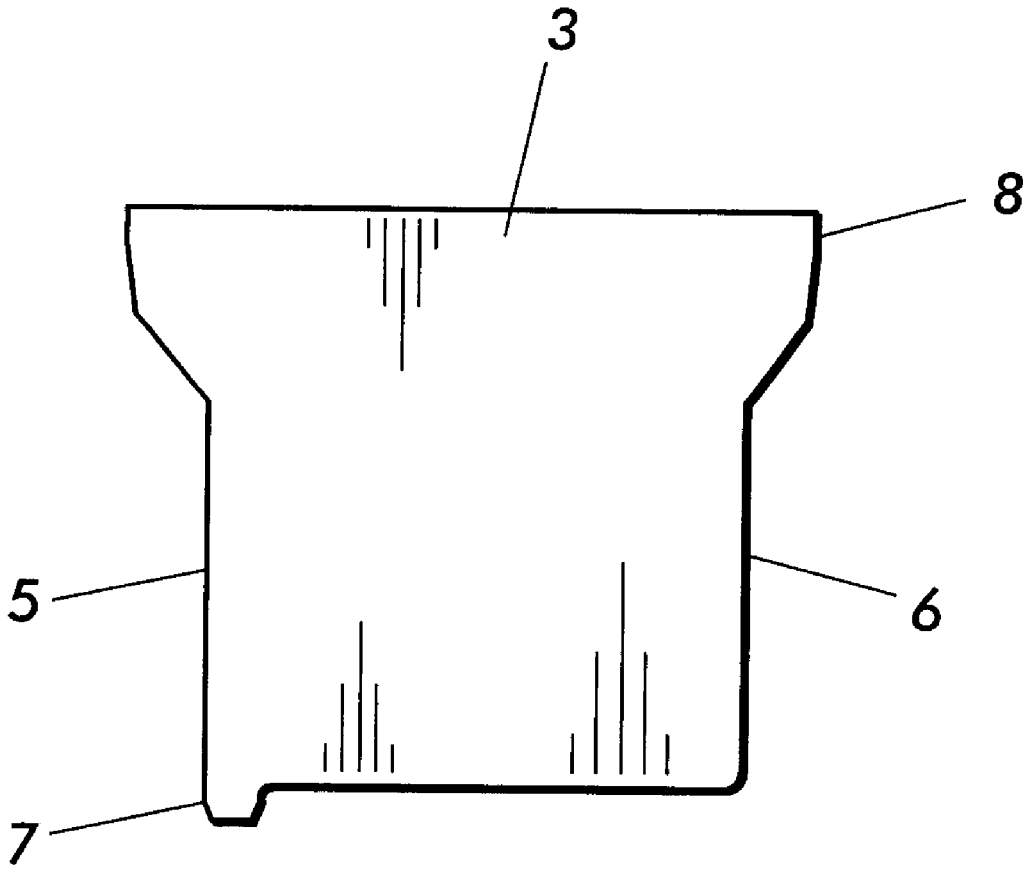
FIG. 3 illustrates a front view of an exemplary embodiment of one of the ink sticks of FIG. 2.

FIGS. 2 and 3 illustrate embodiments of ink sticks for use with the embodiments of an ink loader described herein. As will be noted repeatedly during the description of embodiments, the exact configuration of the ink sticks disclosed herein is not important either to the ink loader disclosed herein, or to specific components thereof. However, a description of general features of the ink sticks is useful for a better understanding of the disclosed embodiments of an ink loader.

Solid ink sticks 2 are used in phase change ink jet printers such as the printer 10 shown in FIG. 1. In embodiments, the ink sticks have a generally top portion, which can be a substantially horizontal top surface, and a generally bottom portion, which can be a substantially horizontal bottom surface. Side surfaces connect the top and bottom of the ink stick. The side surfaces can be substantially linear from top to bottom, or they can be stepped or segmented, as seen in FIG. 3. In embodiments, the ink sticks for the different ink feed channels of a particular printer can be made identically. In other embodiments, such as the embodiments shown in FIG. 2, each color of ink stick can be made to have a particular perimeter shape, as viewed from above the ink stick, different from the perimeter shapes of other colors of ink sticks. The ink stick perimeter shape can be the shape of either the top or the bottom (or both) of the ink stick, or of protruding portions from the sides of the ink stick. In FIG. 2, each ink stick has a face surface 3, a rear surface 4, a first side surface 5, and a second side surface 6. In the embodiment shown in FIG. 2, the face surface 3 and the rear surface 4 have nonplanar contours. Further, the face surface 3 and the rear surface 4 are designed to substantially complement each other so that the sticks nest together in a feed channel, as described more fully in U.S. patent application Ser. No. 10/135,089, entitled ALIGNMENT FEATURE FOR SOLID INK STICK, and filed Apr. 29, 2002 by BRENT R JONES et al., the content of which is incorporated herein by reference.

The perimeter shape as viewed from the top of the ink stick may include features that extend from the side surfaces below the ink stick top surface. Unless stated otherwise, when the term perimeter is used it shall mean the view looking down on the ink stick, as opposed to the perimeter of the top surface of the ink stick.

Ink sticks can have different shapes to distinguish among different ink sticks. In particular, ink sticks can have different outer perimeter shapes to provide differentiation. Different portions of the perimeter of the ink stick can be associated with different differentiation elements.

In embodiments, the contours of at least portions of the face surfaces 3 and the contours of at least portions of the rear surfaces 4 can be used to distinguish the particular printer model in which the ink sticks should be used. In such embodiments, each ink stick in a particular printer model would have the same face surface contour and the same rear surface contour regardless of the color of the ink stick. However, the contours of the face surfaces and rear surfaces of the ink sticks would be different than the contours of the face and rear surfaces of ink sticks in other printer models. When used with complementary insertion openings or receptacles 24 in the key plates 18 (shown in FIGS. 5 and 6) or push blocks 50 (shown in FIGS. 23–26), the contours of the front 3 and 4 rear surfaces help prevent the user from adding the wrong ink sticks to a particular printer.

In embodiments, each color of ink stick 2A–D has its own distinctive shape differentiated from other colors of ink sticks by its side surfaces (5,6). The contour of the first side surface 5 and the contour of the second side surface 6 can be different for each color. When used with complementary insertion openings or receptacles 24 in the key plates 18, the side contours help prevent the user from adding the wrong ink sticks to a particular channel. In embodiments, the front 3 and rear 4 surfaces could also be used to distinguish different colors of ink sticks. Likewise, the side surfaces 5 and 6 could be used for model differentiation. In other embodiments, any combination of the surfaces of the ink sticks can be used for various differentiating functions.

FIGS. 2 and 3 are meant to be exemplary and the particular contours of the face, rear, and side surfaces of the ink sticks and key plates shown in these figures should not be considered limiting. Further, the ink sticks can be any color, but typically will be one of the following four colors: cyan, yellow, magenta, and black. Each color of ink stick will have approximately the same volume as the other colors.

FIG. 3 illustrates a front view of the ink sticks of FIG. 2. In embodiments, each of the ink sticks 2A–D has a lower guide element portion 7 formed as part of an extremity of the ink stick body. In the illustrated embodiment, the guide element portion 7 extends downward from near one edge of the ink stick body. This guide element portion 7 fits into, and slidingly engages, a channel guide rail 26 (see FIG. 16) of a feed channel 25 of the ink stick loading bin or loader 16. The ink stick guide element portion 7 is one of the supporting features of the ink sticks, and provides a first area, line, or point of contact between the ink stick and the feed channel. Each ink stick also has a second guide element portion 8 formed on the opposite side of the ink stick body from the first guide element. The second guide element portion 8 can be formed near the upper portion of the inks stick, as a portion of one side of the top of the ink stick. The second guide portion 8 provides a second area, line, or point of contact between the ink stick and the feed channel.

Figure 4:
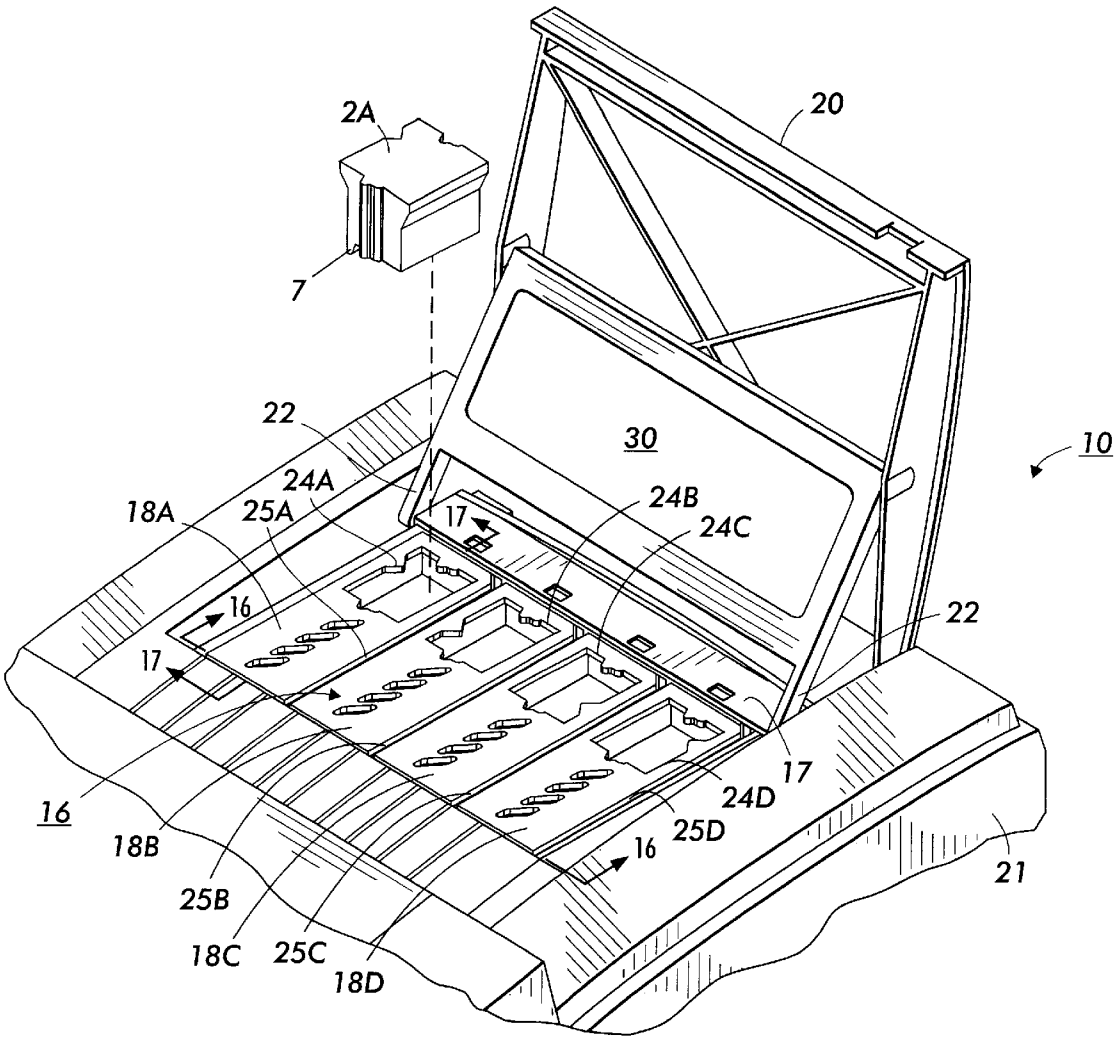
FIG. 4 is an enlarged partial top perspective view of the printer of FIG. 1 with the ink access cover open showing a solid ink stick in position to be loaded into the appropriate ink stick receptacle.
Figure 15:
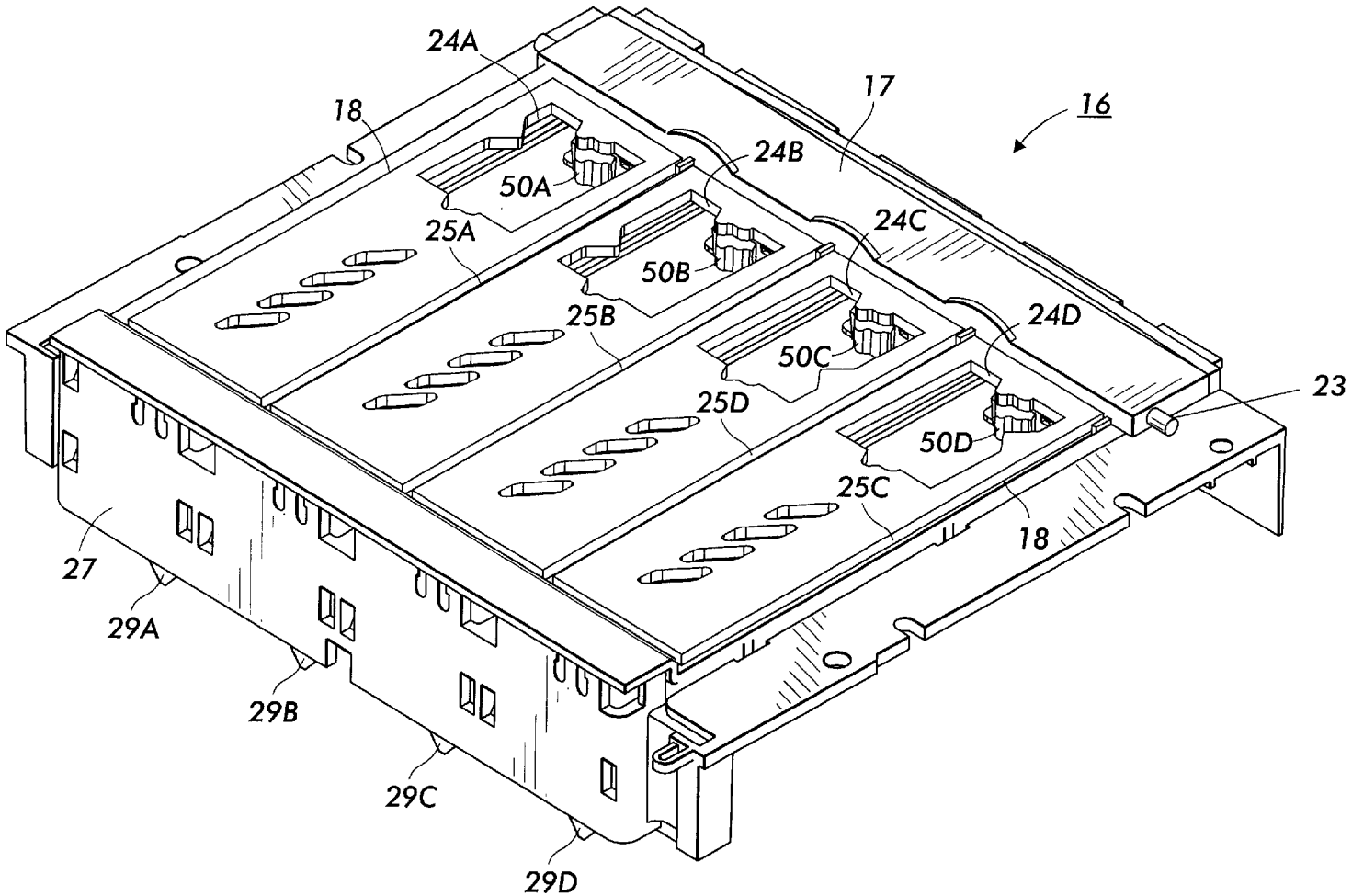
FIG. 15 illustrates a perspective view of an exemplary embodiment of a feed channel of an ink stick feeder incorporating the key plates of FIG. 5.
Figure 16:
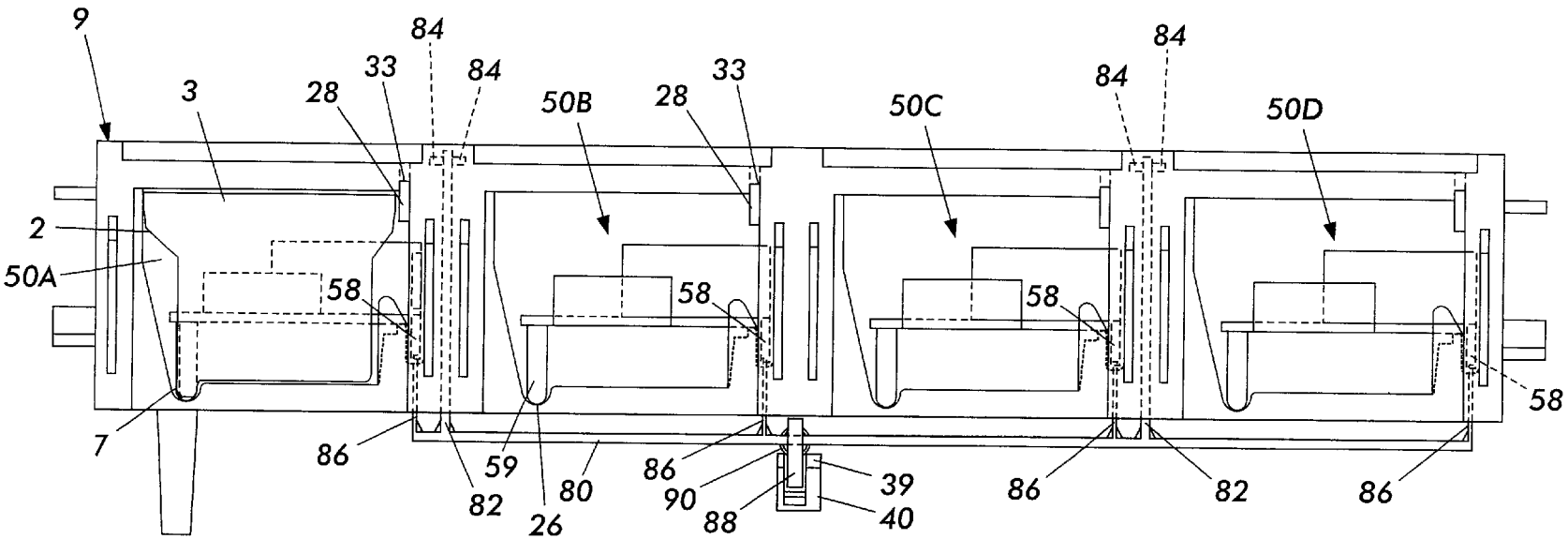
FIG. 16 illustrates an elevated end view of an exemplary embodiment of the ink stick feeder of FIG. 15, taken along line 16—16 of FIG. 4.

FIG. 4 illustrates the printer 10 with its ink access cover 20 raised. The printer 10 includes an ink load linkage element 30, and an ink stick feed assembly or ink loader 16. In embodiments, key plates 18 are positioned within the printer over a chute 9 divided into multiple feed channels 25. A view of the chute 9 is shown in FIG. 16. Each of the four ink colors has a dedicated channel for loading, feeding, and melting in the ink loader. The channels 25 guide the solid ink sticks toward the melt plates 29 (see FIG. 15), located at the opposite end of the channels from the key plate insertion opening. These melt plates melt the ink and feed it into the individual ink color reservoirs within the print head (not shown) of the printer 10. The chute 9 in conjunction with key plates 18 and melt plates 29 also provides a housing which can accommodate a single or plurality of ink sticks of each color which is staged and available for melting based on printer demands.

Figure 5:
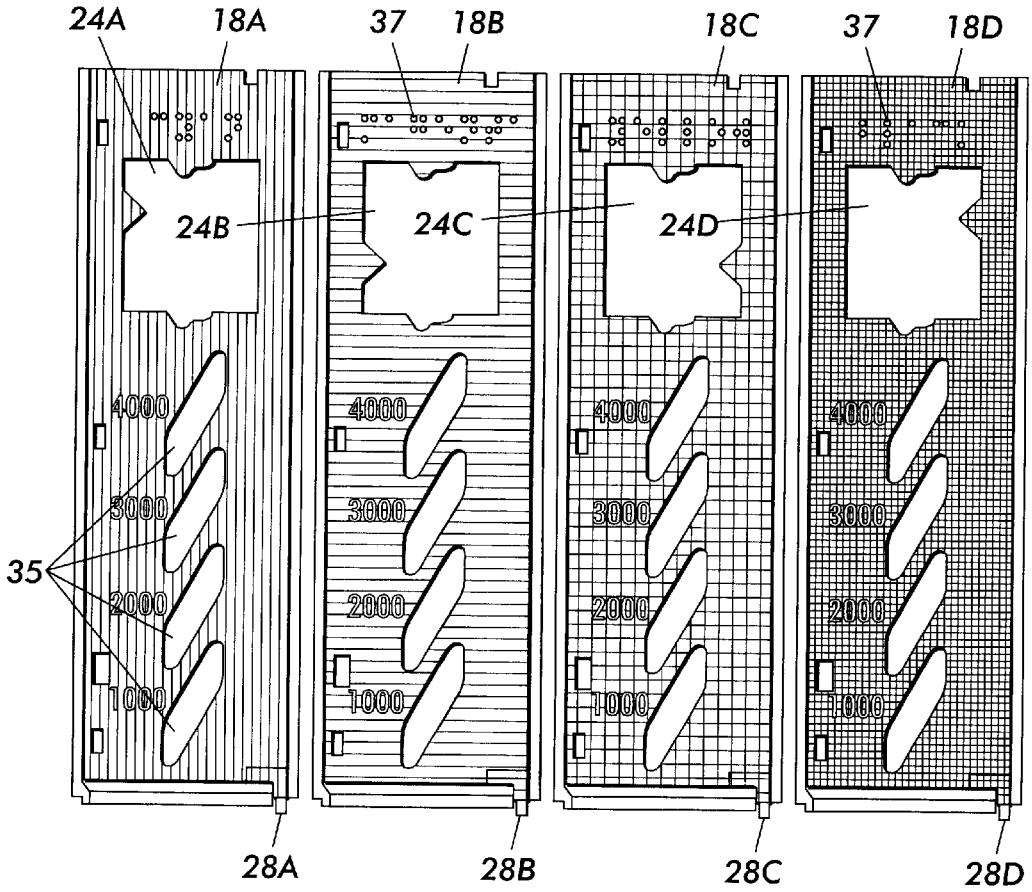
FIG. 5 illustrates a top view of an exemplary embodiment of a set of key plates for the printer of FIGS. 1 and 4, wherein the key plates have insertion openings corresponding to the ink sticks of FIGS. 2 and 3.
Figure 6:
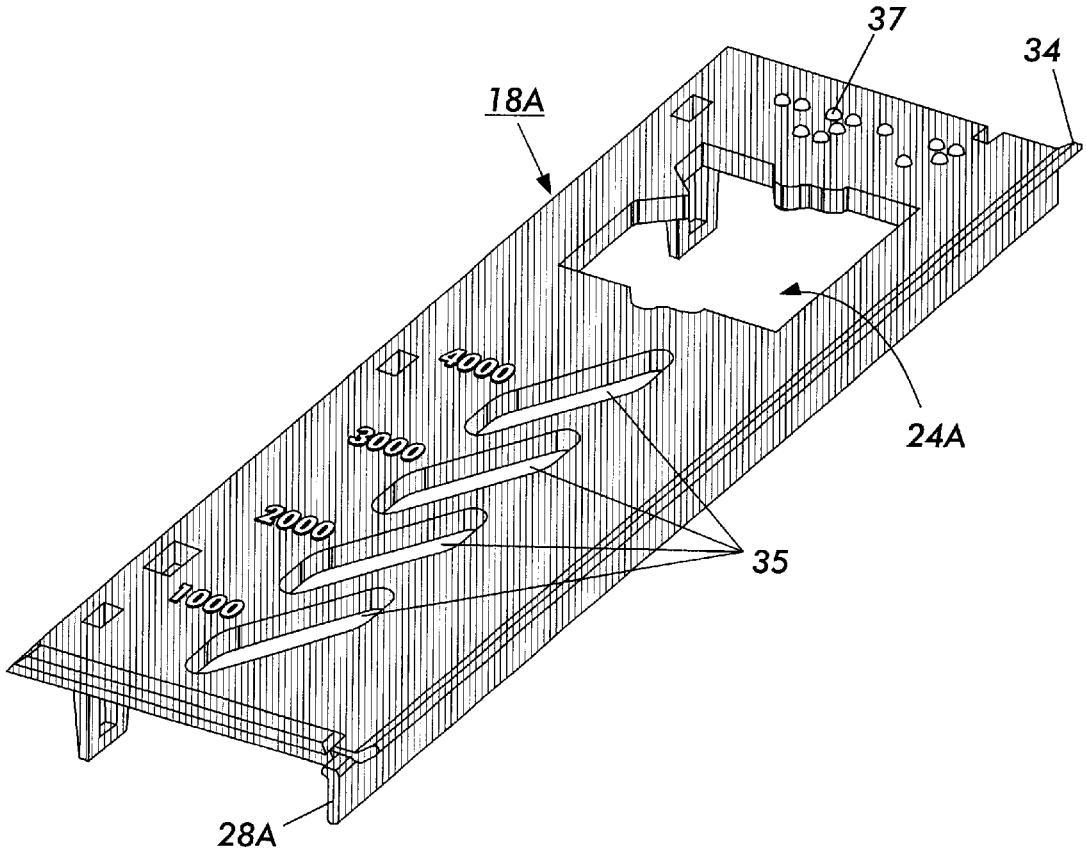
FIG. 6 illustrates a perspective view of the leftmost key plate of FIG. 5.

Embodiments of the printer include either a single key plate, or multiple key plates 18 for different feed channels 25. In the illustrated embodiment, each feed channel has an individual key plate. FIGS. 5 and 6 illustrate in detail the key plates that control which ink sticks 2 enter which feed channels 25. The key plates 18A–D have receptacles or insertion openings 24 through which ink sticks are inserted into the channels 25. While each key plate 18 of FIGS. 5 and 6 has a single insertion opening 24 located near the rear of the key plate, it is possible to use multiple insertion openings.

The insertion openings 24 in the key plates 18 are shaped to substantially match the perimeter shape of the ink sticks 2 as viewed from the top surface of that ink stick. Each of the key plates 18 corresponds to a particular channel 25 and has a shaped or keyed insertion opening or receptacle 24 corresponding to a particular ink stick perimeter shape. In embodiments, this differentiation is provided by forming each color of ink stick 2A–D with differently shaped face, rear, first side, and/or second side features, and forming each key plate 18 with a correspondingly keyed opening or receptacle 24. Keying makes accidental mixing of the ink stick colors improbable. The keying of the ink sticks 2A–D and openings 24A–D help prevent color contamination of the inks in the individual color reservoirs (not shown) in a print head (also not shown). Some of the keying elements of the ink stick may be eliminated from certain segments of the key plate insertion opening in favor of incorporating the keying function for those segments in the push block 50 or other components of the ink loader 16, such as one of the walls of each channel 25 of the chute 9.

Figure 8:
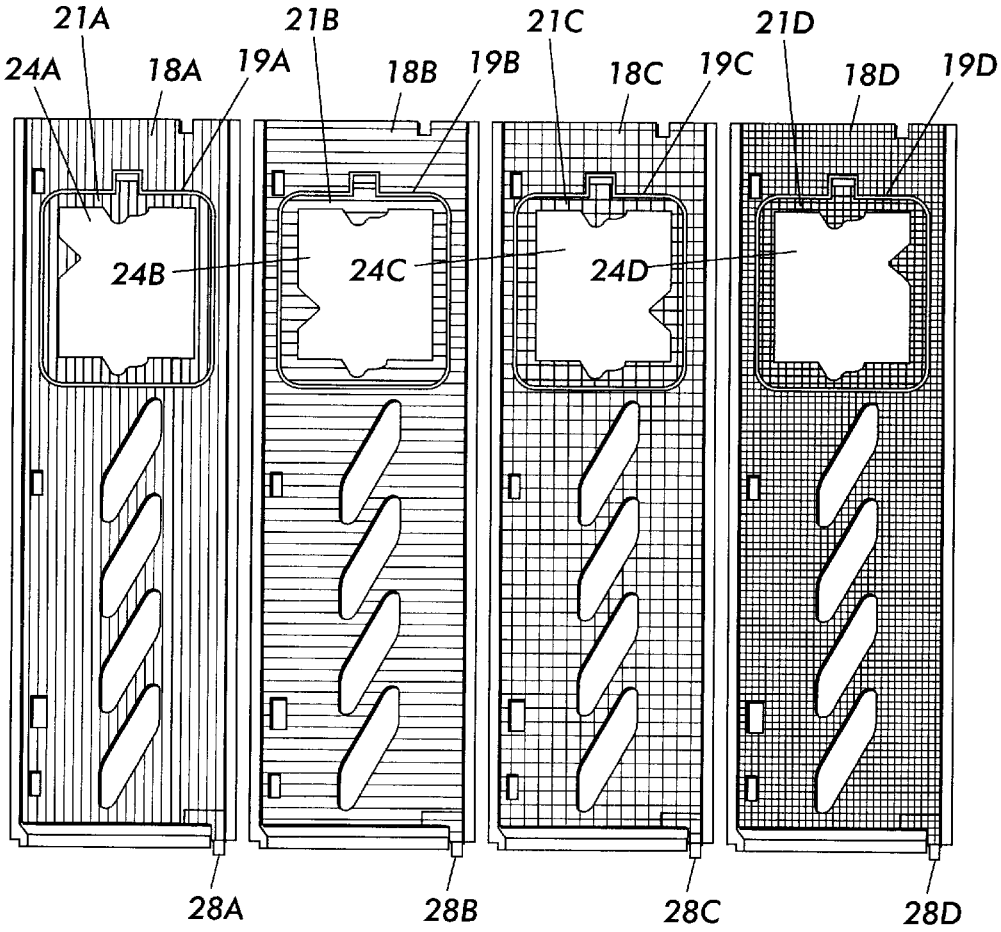
FIG. 8 illustrates a top view of another exemplary embodiment of a set of key plates for the printer of FIGS. 1 and 4.
Figure 9:
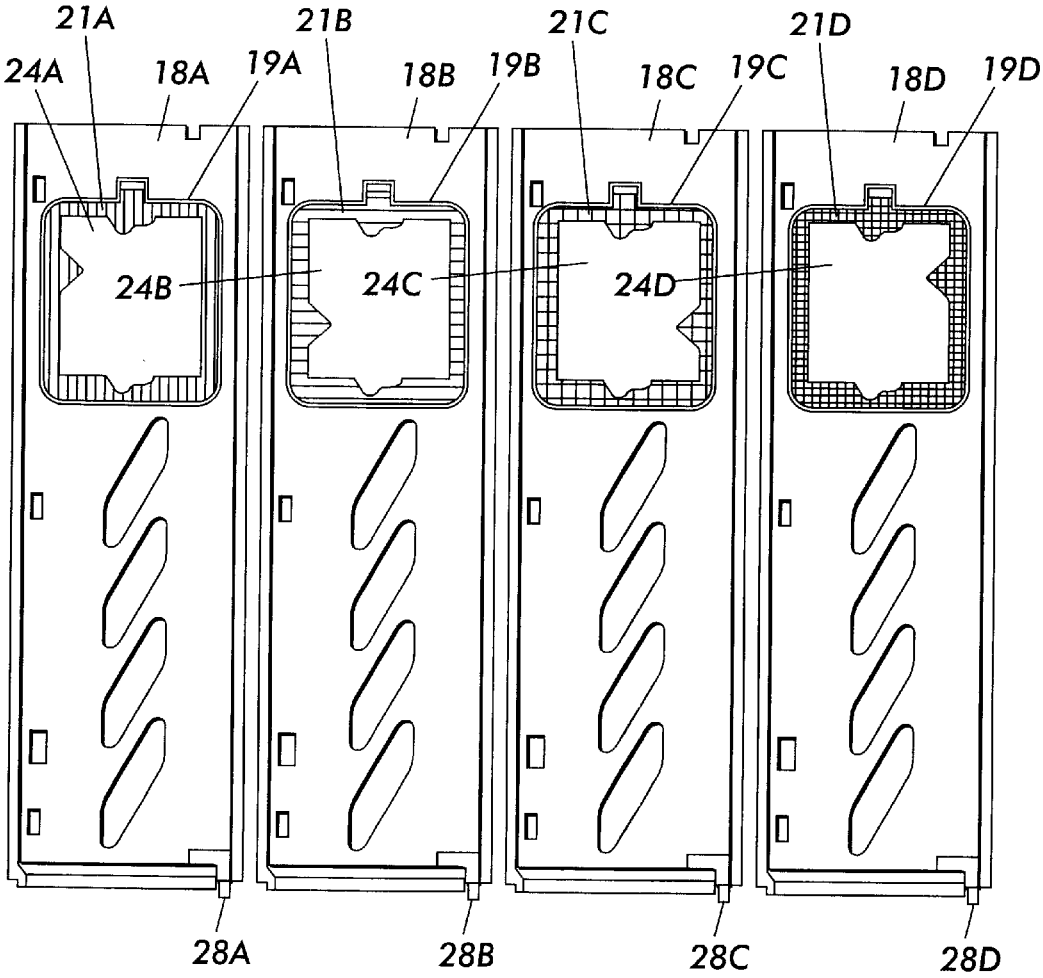
FIG. 9 illustrates a top view of yet another exemplary embodiment of a set of key plates for the printer of FIGS. 1 and 4.
Figure 10:
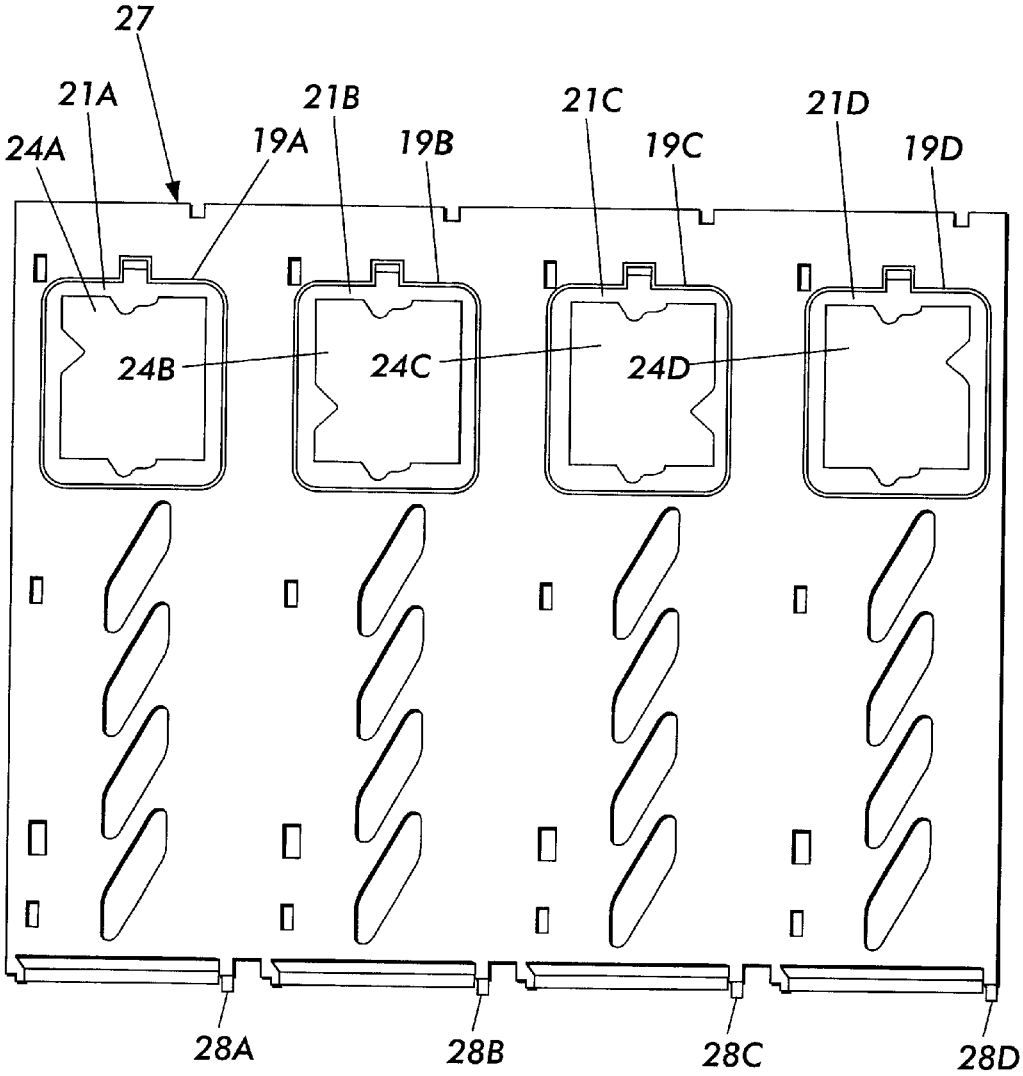
FIG. 10 illustrates a top view of an exemplary embodiment of a single key plate for the printer of FIGS. 1 and 4.
Figure 11:
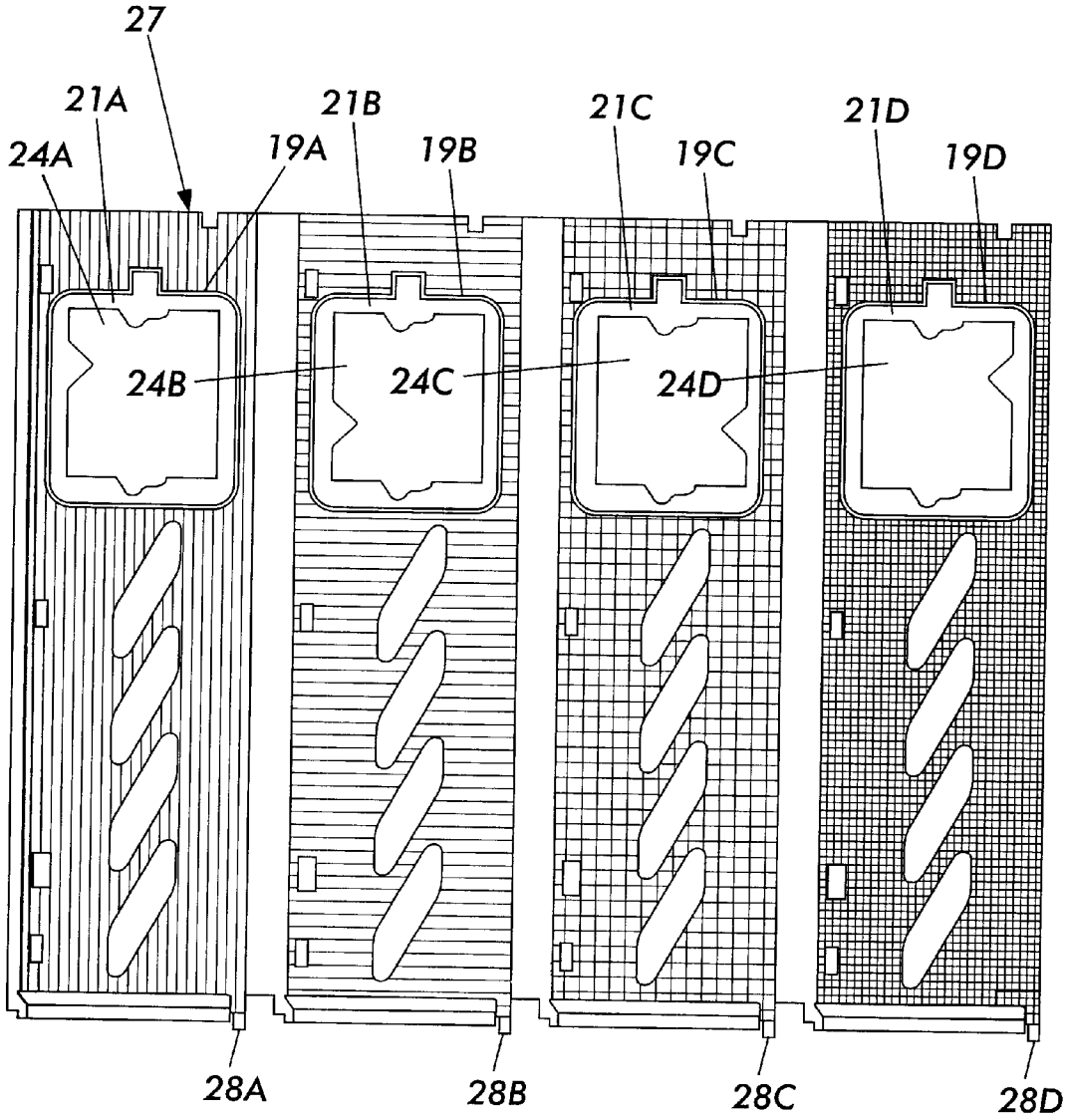
FIG. 11 illustrates a top view of another exemplary embodiment of a single key plate for the printer of FIGS. 1 and 4.
Figure 12:
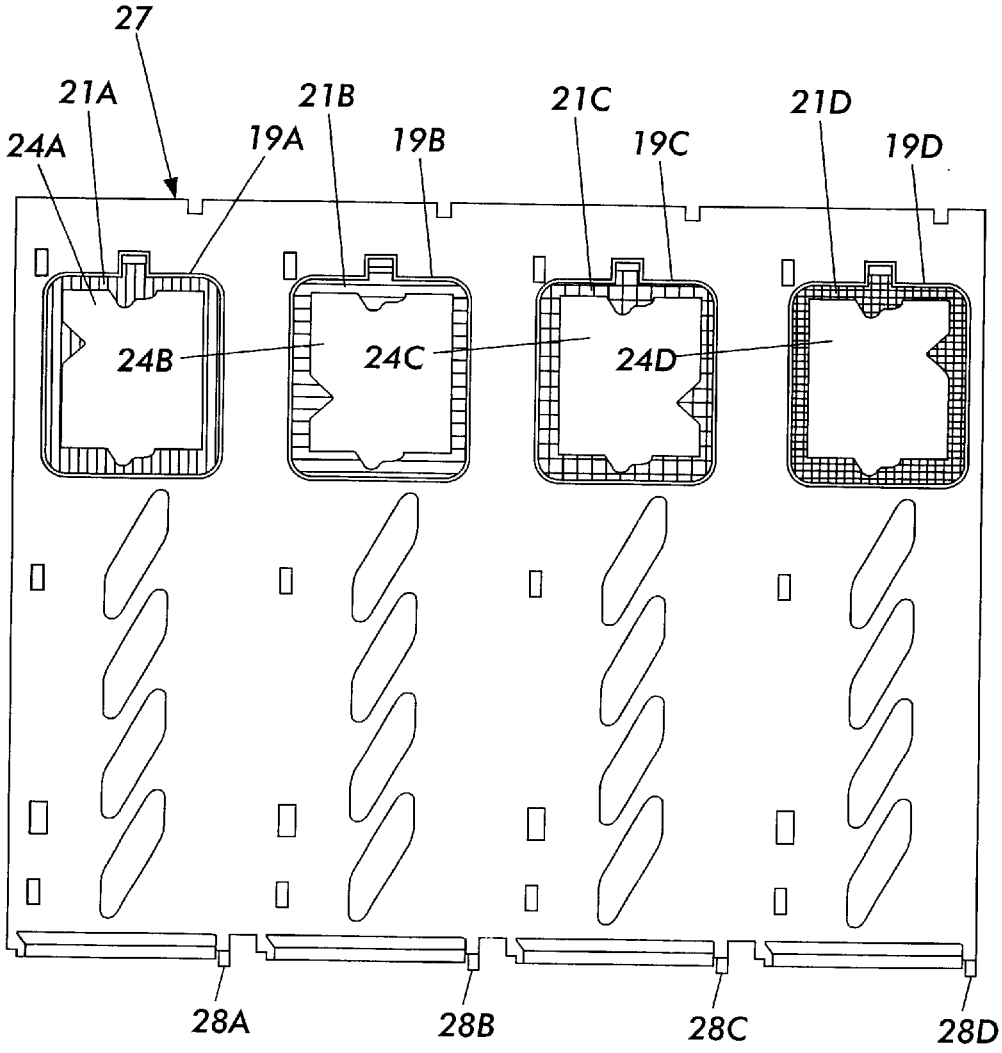
FIG. 12 illustrates a top view of yet another exemplary embodiment of a single key plate for the printer of FIGS. 1 and 4.

In addition to, or instead of, individual key plates, separate insertion opening surround elements 21 can be formed and inserted into enlarged key plate receptacles 19 through the key plate(s). In embodiments, the enlarged key plate receptacles 19 may have a common perimeter shape. In such an embodiment, each insertion opening surround element 21 has an outer perimeter that substantially matches the shape of the enlarged key plate receptacles 19. The insertion opening surround elements can be formed with appropriately shaped openings 24 to admit the proper ink sticks into the feed channel. FIGS. 7–12 illustrate multiple key plates using insertion opening surround elements 21. FIGS. 10–12 show a single key plate 27 for use with a chute, the key plate 27 having multiple insertion opening surround elements 21 placed therein.

The surround elements can connect to the key plate receptacles by any of a number of means that are well known in the art. These can include, for example, a simple snap-fit or pressure fit and vibratory welding.

Separate key plates 18 or ink stick insertion opening surround elements 21 offer flexibility in ink loader manufacturing and assemblies. When individual key plates or insertion opening surround elements are used, it is easier for the user to use color matching to indicate which channels carry which color of ink stick. Having individual key plates or insertion opening surround elements provides improved design and manufacturing flexibility and greater assembly options. For example, the use of a new printhead may require a change in the color order of the channels. The same manufactured key plates could be used in a new printer using this design. However, they would just be inserted in a different order. Additionally, a printer can be retrofitted to accommodate differently shaped ink sticks by replacing the individual key plates 18 or individual insertion opening surround elements 21.

In embodiments, the key plates 18 or portions thereof, or insertion opening surround elements 21 can be colored or otherwise marked to enhance the user's ability to correctly identify the appropriate receptacle for each type of ink stick. FIGS. 5–6 illustrate independent key plates 18A–D that are individually colored to match or complement the ink color assignments for each ink loader color channel. There are many ways that the key plates 18 could be color-coded. For example, an entire key plate could be molded or shaded with a color complementary to the ink to be inserted or a portion of the key plate could be shaded. Such shading can be provided by forming the key plate or portion thereof with injection molded plastic, and impregnating the plastic with the appropriate color. The ink stick colors can be dark and hard to distinguish in sufficiently dense quantities. In embodiments, each key plate 18A–D or insertion opening surround element 21 can be impregnated with a sufficiently low density of the color of the ink stick to which it corresponds that the colors are clearly distinguishable among the key plates or surround elements. Key plates formed in this manner can be opaque, translucent, or substantially transparent. In alternatives, the key plates can be formed of materials such as other plastics, metals, woods, etc., and all or a portion of the key plate can be painted or powder coated with a colorant, or a label with an appropriate color could be applied to the key plate.

Figure 7:
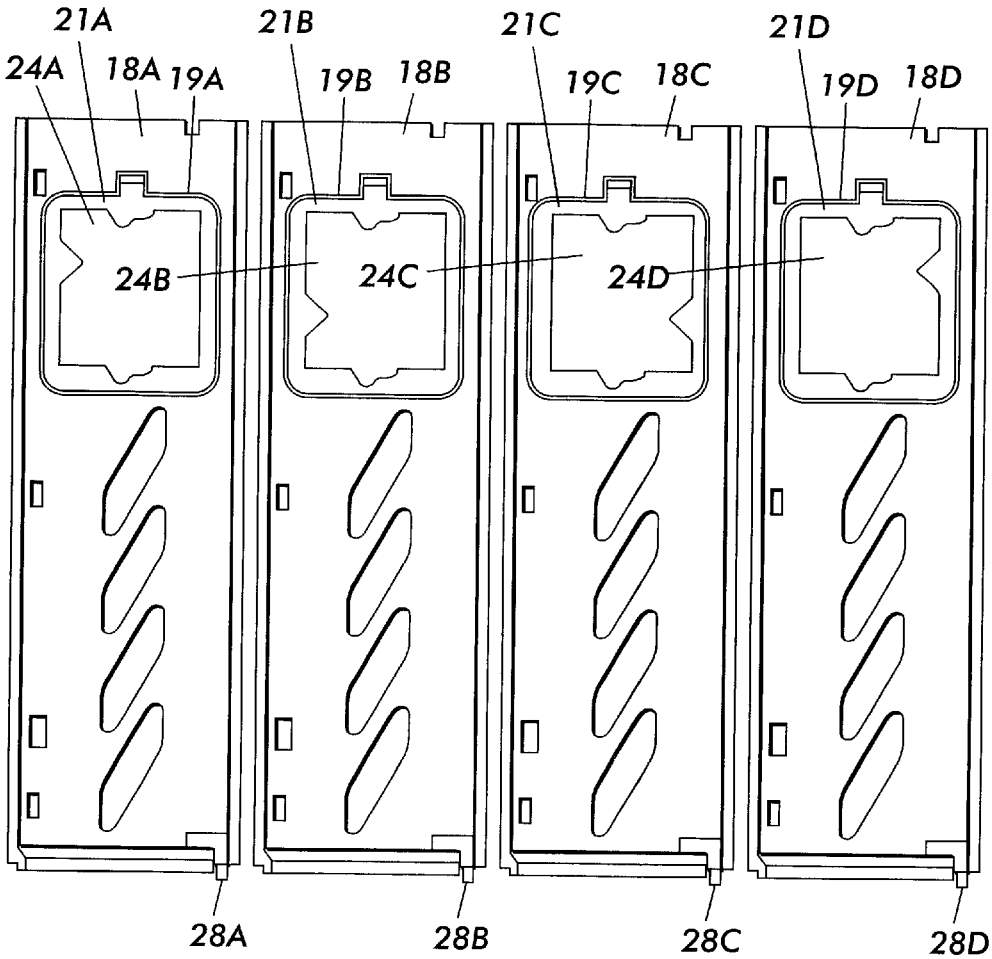
FIG. 7 illustrates a top view of an exemplary embodiment of a set of key plates for the printer of FIGS. 1 and 4.

In embodiments, the surround elements 21 can also include color indication markings such as color shading to identify which color of ink stick should be admitted to a particular feed channel. FIGS. 7 and 10 illustrate embodiments that do not include color-coding. FIG. 7 shows neither multiple key plates 18 nor individual insertion opening surround elements 21 having color-coding features. FIG. 10 shows a one-piece key plate 27 and individual insertion opening surround elements 21 that do not have color shading. Embodiments that include color-coding are illustrated in FIGS. 8, 9, 11, and 12. FIG. 8 shows insertion opening surround elements 21 having color identification markings thereon used in conjunction with multiple colored key plates 18. FIG. 9 shows insertion opening surround elements 21 having color identification markings thereon used in conjunction with multiple key plates having no color indicating markings. FIG. 11 shows insertion opening surround elements 21 having color identification markings thereon used in conjunction with a colored key plate 27. FIG. 12 shows insertion opening surround elements 21 having color identification markings thereon used in conjunction a key plate having no color indicating markings. Other color indicating markings can be used as well. In embodiments, each key plate could also include tactile features 37 (see FIGS. 5 and 6) in addition to or instead of coloring. Such features could include writing or numerals to identify which color is associated with a particular key plate. The writing or numerals could be, for example, printed, molded, formed, embossed, or engraved on the key plate surface. Braille lettering or some other tactile alphabet could also be used. In other embodiments, a repetitive tactile feature could be associated with a particular color. For example, a key plate with raised horizontally extending ridges along its surface might correspond to magenta, while a key plate with a series of recessed vertically extending depressions might correspond to cyan.

In addition to, or instead of, color-coding the key plates, the yoke 17 (FIG. 4) could contain color-coded labels positioned over the appropriate channel 25 to signify what color should be inserted in which channel.

FIG. 5 illustrates an exemplary embodiment of a color-coding scheme. The vertical lines drawn in the leftmost key plate 18A represent magenta, the horizontal lines drawn in the next key plate 18B from the left represent cyan, the large grid pattern drawn in the next key plate 18C from the left represents yellow, and the smaller grid pattern drawn in the right most key plate 18D represents black. The color order can be in any sequence, appropriate to a specific printer.

In embodiments used with ink sticks that are substantially identical to each other, there will be little or no differentiation between the openings 24 in the key plates. In these cases, color-coding of the key plates or the yoke is particularly helpful for preventing accidental insertion of the wrong-colored ink stick in a particular channel.

In other embodiments, such as the embodiments shown in FIGS. 5–14, each key plate 18 or insertion opening surround element 21 has an insertion opening 24 having a shape chat corresponds to (is keyed to) the perimeter shape of a particular color of ink stick. Ink sticks 2 are inserted into the appropriately shaped openings 24 at the insertion end of each feed channel. Appropriately keyed insertion openings can contribute to new and improved, customer friendly ink shapes with a family appearance. In embodiments, the openings can have recognizable shapes to facilitate color slot keying. In embodiments, the features of the opening that control which ink sticks can enter a channel can be located on the left and right borders of the opening. These embodiments would be used for ink sticks such as 2A–D, which have color distinguishing features on their left and right sides. The front and rear sides of the openings can be the same for a particular printer model or group of models. These shapes could be made identical for each key plate of a given model but could be changed on different printer series or models, enhancing the family appearance of the ink used for each printer model. Alternatively, the ink sticks could be designed to have color distinguishing features on the face and rear surfaces as well as, Or instead of, the left and right sides. The left and right sides might also include model keying features. In those embodiments, the key plates corresponding to those ink sticks would have keyed features on the front and rear sides of the opening. Fully enclosing the insertion opening not only helps enable four sides of a more or less square or rectangular ink stick to be used for keying, but also allows for keying of ink sticks having any number of sides (or even no sides at all, such as, for example, a cylindrical ink stick). Ink sticks incorporating various perimeter shape distinctions are described in co-pending U.S. patent applications Ser. No. 10/135,085, MULTIPLE SEGMENT KEYING FOR SOLID INK STICK FEED, by Jones et al., Ser. No. 10/135,034, SOLID INK STICK WITH IDENTIFIABLE SHAPE, by Jones, and Ser. No. 10/135,049, KEYING FEATURE FOR SOLID INK STICK, by Jones, all filed Apr. 29, 2002, the contents of which are hereby incorporated by reference.

In embodiments, each key plate 18A–D also has one or more ink level viewing areas 35 located between the plate's insertion opening 24 and the melt end of the feed channel beneath the key plate. These viewing areas 35 provide a visual cue to the user of how many ink sticks 2 are left in a channel 25 by allowing the user to see the ink sticks in the channel, especially the location of the last ink stick in the channel. The viewing areas 35 may be labeled with markings indicating the percentage of fullness of each channel or the approximate number of prints that might be made if the prints contained an average amount of color from a channel. For example, these markings could include numbers. In embodiments, the viewing areas could be windows of a substantially transparent material, such as plastic. In other embodiments, the viewing areas could be open spaces and function as access openings through the key plate. The access openings would allow a user to physically adjust the ink stick or ink sticks in a particular channel. One reason a user may want access would be to eliminate a jam. When the ink access cover 20 is opened, as seen in FIG. 4, the viewing and access apertures 35 in each key plate 18 make it easy to assess the remaining ink supply for all ink stick colors.

Figure 13:
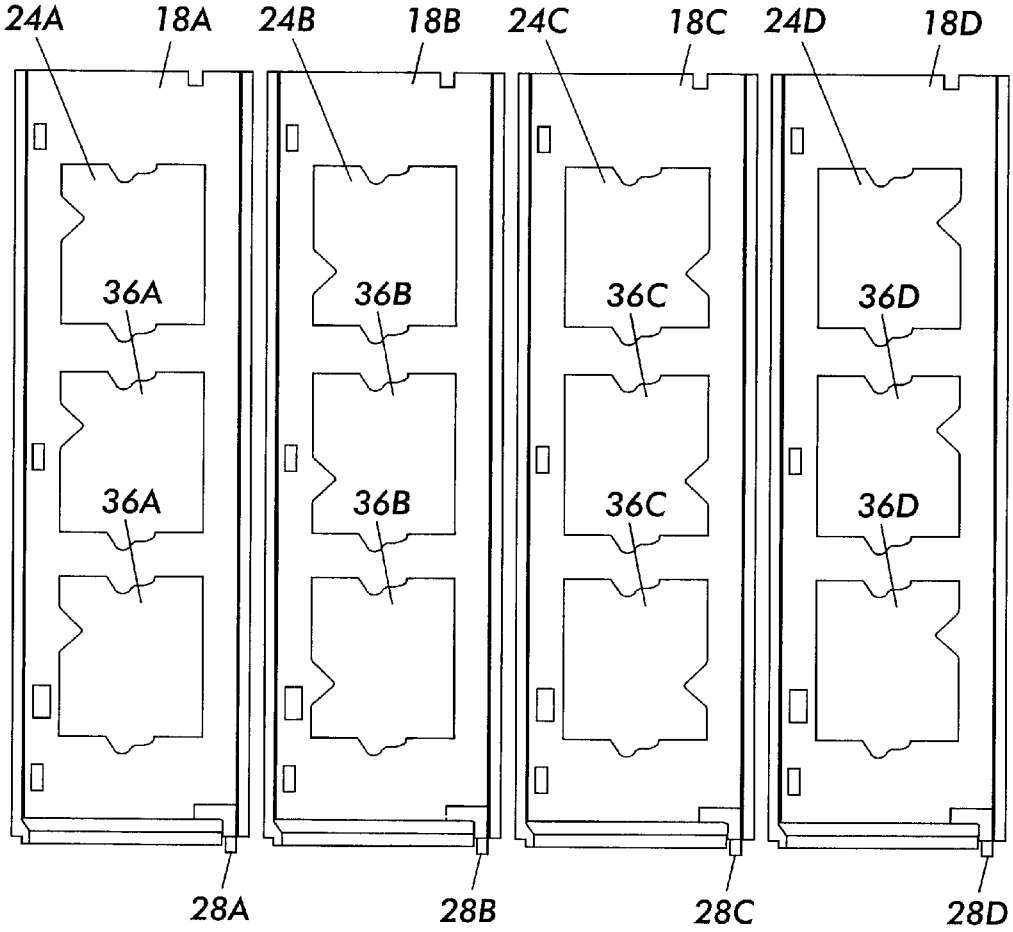
FIG. 13 illustrates a top view of an exemplary embodiment of a set of key plates for the printer of FIGS. 1 and 4.
Figure 14:
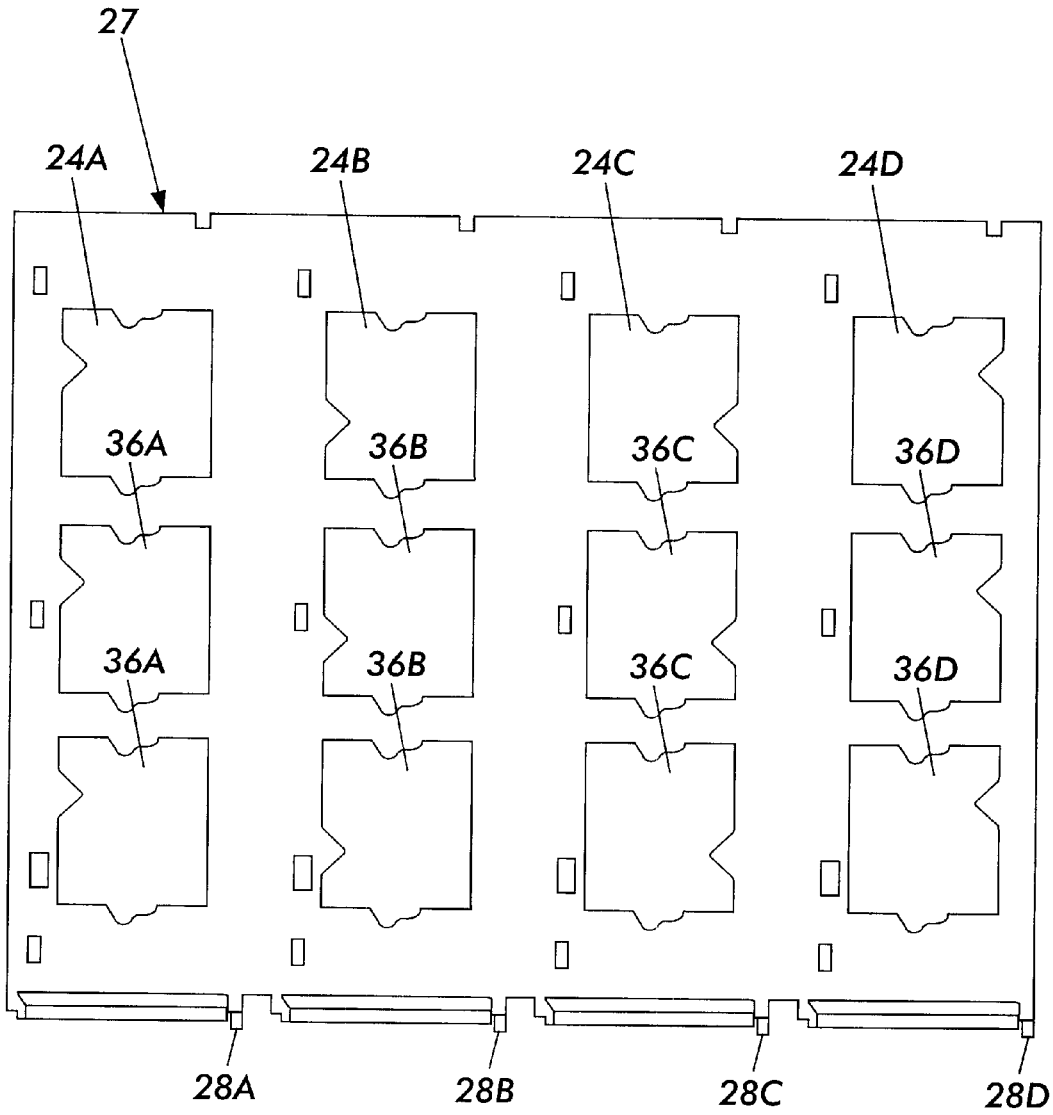
FIG. 14 illustrates a top view of an exemplary embodiment of a single key plate for the printer of FIGS. 1 and 4.

In embodiments, the access openings could also take the form of more insertion openings 36 over the same channel, as seen in FIGS. 13–14. These added insertion openings 36 allow the user to load ink faster in addition to providing viewing areas and greater access for adjusting the ink sticks in the feed channel.

In embodiments, each feed channel includes a channel guide portion that interacts with ink stick guide portions on the ink sticks to support and guide the ink sticks as they move along the feed channel. For example, each key plate can include a guide portion such as the rail 28 that extends downward from the key plate underside surface into a channel through which ink sticks pass. The guide rail 28 extends out past the interface between chute front and key plate and helps guide ink sticks towards the melt plates 29, which are mounted a short distance beyond the end of the chute channels. The guide portion 28 of the key plate can serve as a support for the upper edges of ink sticks in a channel. For example, guide portion 28 supports the second or upper guide portion 8 that extends off to the right side of the ink stick shown in FIG. 3. The second guide portions 8 of the ink sticks will generally stay in contact with the guide rails 28 for most of the ink sticks' 2 journey down the channels 25.

The channels 25A–D are partially exposed along one edge when the key plates 18A–D are inserted in place. Along this edge, yoke arms 32 (see FIG. 32) extend from the yoke 17 into the channels 25. To reduce the chance of introducing foreign material into the channel and to enhance top surface appearance, the key plates 18 have an extended flange 34 that slopes up and over toward the side, essentially blocking sight straight down into the channel. The flange 34 also helps to prevent things from falling down into the channel where they might impede ink feed or yoke motion.

Referring back to FIG. 4, the ink load linkage 30 is pivotally attached to the ink access cover 20 and a yoke 17. When the access cover 20 is raised, the pivot arms 22 (see FIG. 4) pull on the pivot pins 23 (see FIG. 15) of the yoke and cause it to slide back to a clear position beyond the ink insertion openings 24, thereby allowing ink to be inserted through the ink insertion openings into the ink loader (see FIG. 15). Yoke 17 is coupled to the chute 9 such that it is able to slide from the rear to the front of the chute (toward the melt plates) above the key plates 18 as the ink access cover is closed. Ink stuck push blocks (described below) are linked to the yoke so that this movement of the yoke assists in moving the individual ink sticks 2 forward in the feed channels 25 toward the melt plates 29. Hook features on the yoke 17 allow it to snap in place on the channel side flanges when positioned beyond the normal range of motion, where even in that forced position, it remains clipped to the channel flanges with partial overlap.

In embodiments, the ink sticks and feed channels have been made relatively wide to increase the load density, and the channel floors and sides have been gusseted to maintain moldability and torsional strength. The results provide room for an ink stick that is wider (transverse the feed direction of the feed channel) and consequently can be made shorter in length (along the feed direction of the feed channel).

FIG. 16 illustrates an end view of the ink stick loader 16. Each of the channels 25A–D incorporate ink stick support and guide features for supporting the ink sticks as they move along channels 25. An ink stick 2 is shown in one of the feed channels 25A of the ink stick loader, while the other feed channels are shown empty. In embodiments, Each ink stick is substantially supported along two lines of contact. The first is a lower ink guide 26. In embodiments, the lower ink guide can be configured as a relatively narrow, elongate depression or trough that provides support for a lower guiding feature of the ink sticks. In other embodiments, the lower ink guide can take the form of a raised rail. In these embodiments, the push block could have a recess in the bottom rather than a protrusion.

This lower ink guide 26 is preferably located off toward one side of the channel 25. In embodiments, the lower guide element portion 7 of the ink stick is at least partially engaged with the lower ink guide 26. In some embodiments, the lower ink guide 26 supports the lower guide element portion 7. While the lower ink guide 26 is illustrated as a trough with a recessed, curved bottom in FIG. 16, the particular shape of this guide path could take many shapes that would be configured to match an appropriate guide feature on the ink sticks. These include, but are not limited to, shapes such as a small rising inverted "V", a U or inverted U, or other contour having single or multiple apexes or valleys.

Figure 17:
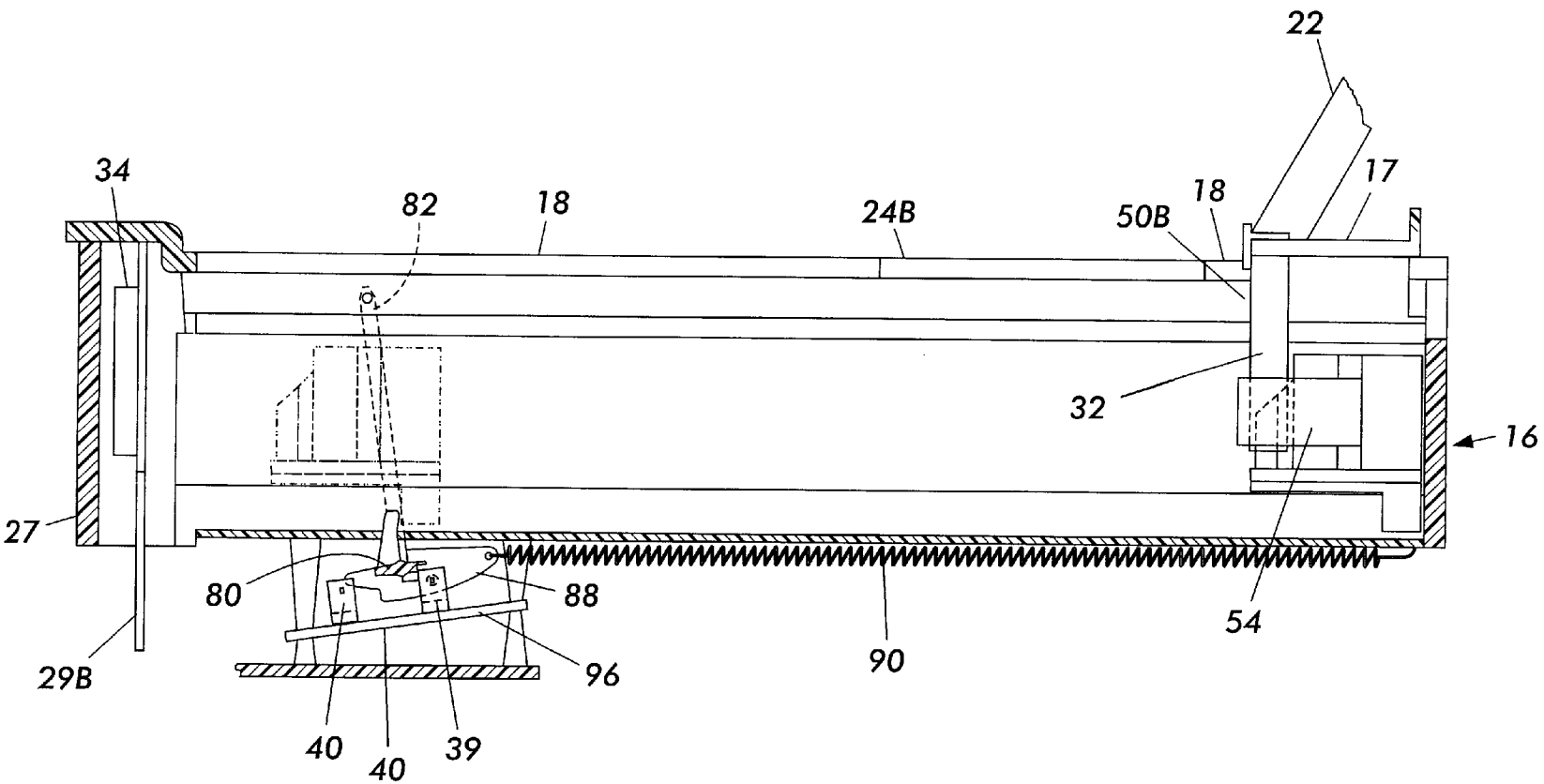
FIG. 17 illustrates a schematic side view of an exemplary embodiment of a feed channel of the ink stick feeder, taken along line 17—17 of FIG. 4.

In embodiments, the second line of contact is between the upper opposite side of the ink sticks 2 and the upper guide rail 28 of the key plates. In embodiments (see FIG. 16), the upper portion of the ink stick 2 includes a protrusion or other ink stick guide extremity 8 that contacts the key plate guide rail 28. The guide rails 28 extend downward from the key plates 18. In the embodiment illustrated, each upper guide rail extends into the feed channel space from at or near one edge of the separate key plates. As can be seen in FIGS. 6 and 17 the key plate guide rails 28 extend beyond the general front of the channels 25. This design provides the ink sticks 2 with greater stability as they contact and are diminished by melting at the melt plates. The key plate guide rails 28 also help position the key plates correctly during assembly of the loaders 16. In this configuration, the extending ends of the guide rails 28 engage notches 33 in the upper crossbeam of the chute so that the front ends of the key plates 18 are properly positioned relative to the channels.

When the channel guide path 26 is located to one side of the center of gravity of the ink stick it supports, the ink stick 2 with its lower guide element portion 7 mating with the lower guide path 26 will lean to the opposite side. In embodiments, the upper guide rail 28 of each of the key plates 18A–D provides a support for the ink sticks near the top and to one side of the ink sticks opposite the center of gravity of the ink sticks from the lower support. This arrangement results in only two optimized lines of contact to support, constrain, and directionally guide the ink toward the melt plates. Better control over the ink orientation is thus obtained and the off side lower support reduces potential contact with small chips and particles of ink.

Although the upper guide rails 28 have been described as part of individual key plates 18, such guide features can also be formed as part of a single key plate that covers multiple feed channels. See FIGS. 10–12. Further, instead of having a guide rail extending from a key plate, the guide rails could extend from the upper walls of the channels 25. Upper and lower channel guides, on either the chute or key plate, can also take the form of a flange, an angled transition in the wall, an inset notch or trough, a protruding extension or rail, or any similar feature running the length of the ink feed range and can be of any appropriate size or configuration that complements or is compatible with the guide and/or support requirements of ink inserted into that channel.

Figure 18:
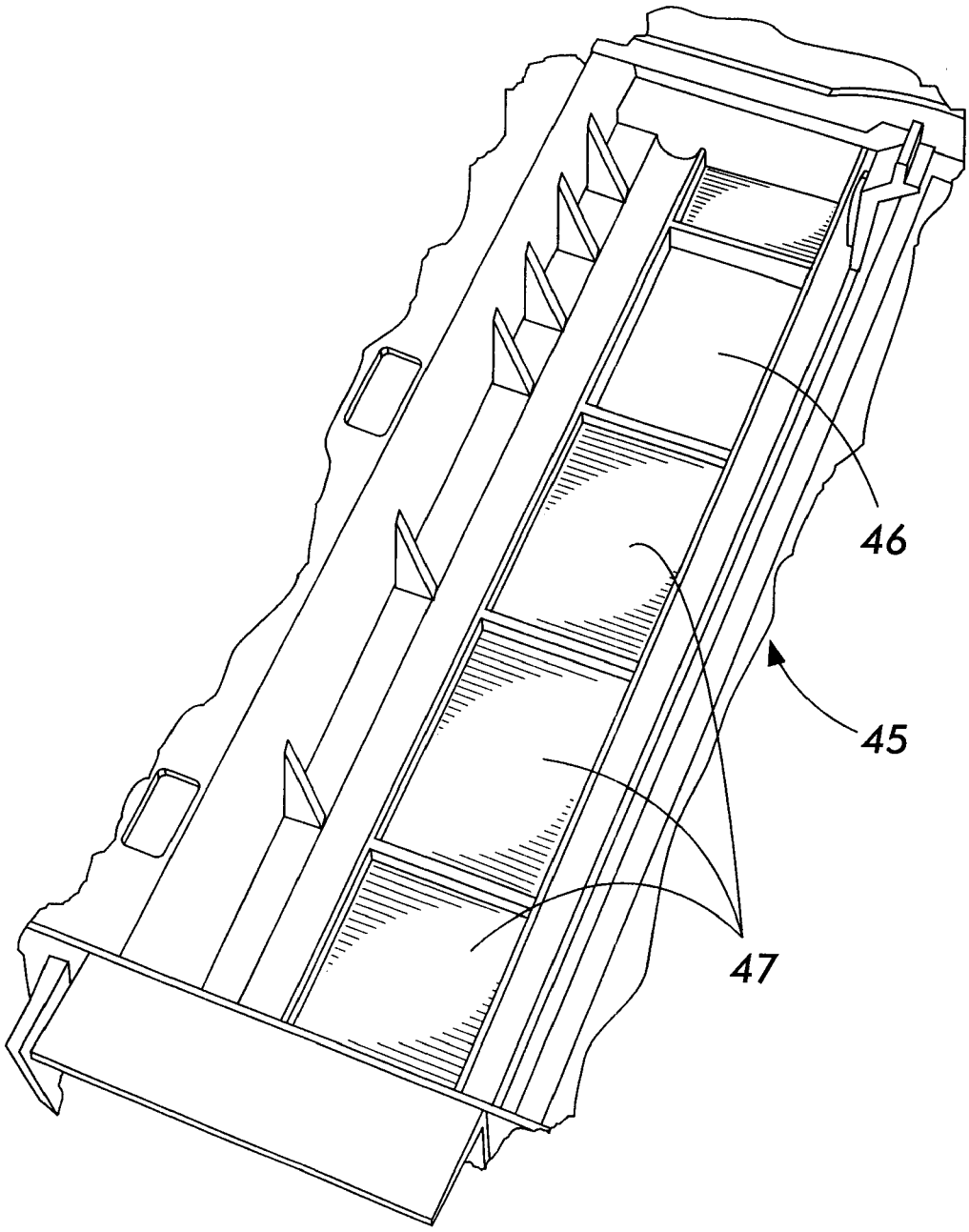
FIG. 18 illustrates an exemplary embodiment of a floor of a feed channel.

The basic dual guide configuration allows greater flexibility in the floor design of the channels. See FIG. 18. Much of the channel floor area 45 under each row of ink sticks does not need to be present to support the ink sticks, so embodiments of the ink loader can have openings 46 or recesses 47 in the floor. In embodiments, the floor can have recesses that ensure little or no contact between the ink stick and any debris such as small chips and other particles of ink, which can collect below the feed slot. In embodiments where the floor includes openings, collection receptacles of various kinds could be used to collect any debris falling out of the chute.

Figure 19:
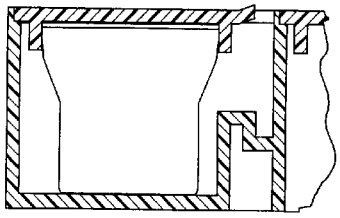
FIG. 19 illustrates a schematic end view of another embodiment of a feed channel of the ink stick feeder.
Figure 20:
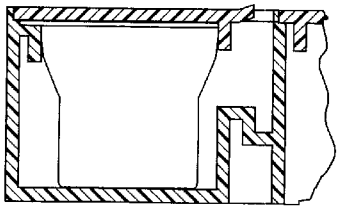
FIG. 20 illustrates a schematic end view of another embodiment of a feed channel of the ink stick feeder.
Figure 21:
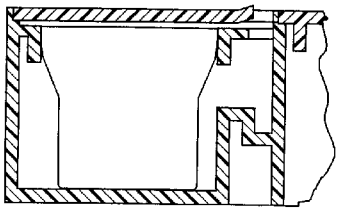
FIG. 21 illustrates a schematic end view of another embodiment of a feed channel of the ink stick feeder.
Figure 22:
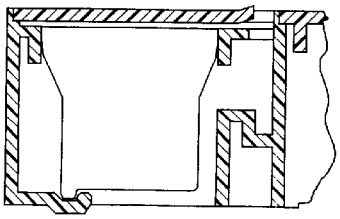
FIG. 22 illustrates a schematic end view of another embodiment of a feed channel of the ink stick feeder.

FIGS. 19–22 show several alternate embodiments of the feed channels and key plates. FIG. 19 depicts an embodiment of a key plate having two elevated guide rails. FIG. 20 depicts an embodiment of an ink loader, wherein the channel wall has an elevated guide rail in addition to the key plate guide rail. FIG. 21 depicts an embodiment of a key plate, wherein the channel has two elevated guide rails. In the latter embodiment, the key plate does not need to have a guide rail at all. FIG. 22 depicts an embodiment using a guide rail located at the base of the ink stick as well as a guide rail supporting the upper portion of the ink sticks.

The ink loader includes a push block 50 for each feed channel 25 to urge the ink sticks in that feed channel toward the melt end of the channel. The push block urging force is provided by a spring. The spring is attached between the push block and the yoke 17 so that moving the yoke toward the melt end urges the push block 50 toward the melt end.

Figure 23:
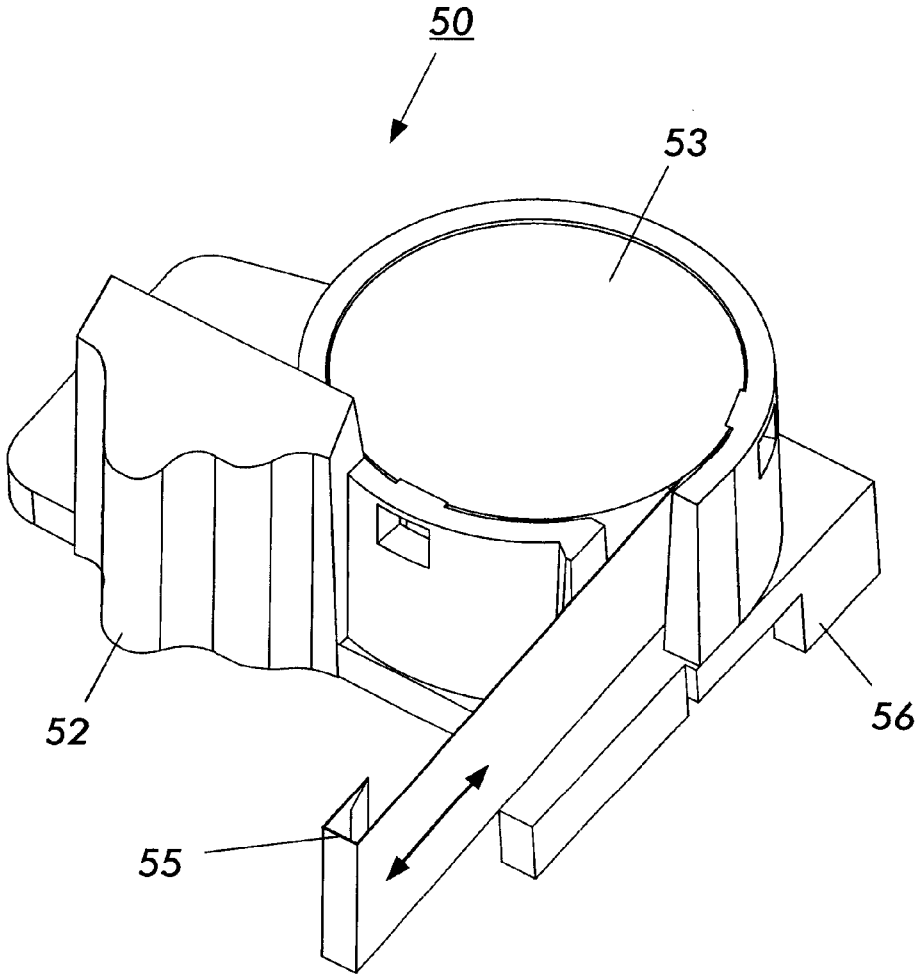
FIG. 23 illustrates a perspective view of an exemplary embodiment of an assembled ink stick pusher including a hub and a side spring.

FIG. 23 illustrates an exemplary embodiment of an ink stick push block 50 including a hub-mounted spring 54. As can be seen in FIG. 23, the spring 54 extends from the side of the push block.

Figure 24:
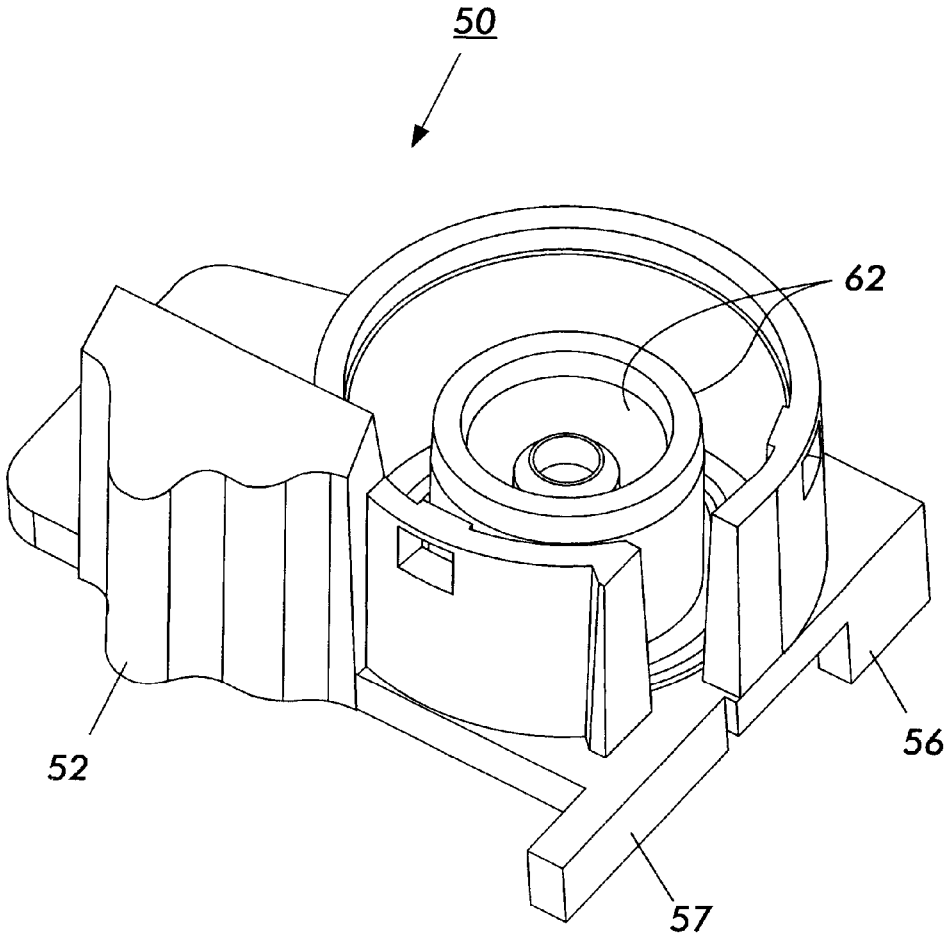
FIG. 24 illustrates a perspective view of the embodiment of an ink stick pusher of FIG. 23 with the hub and spring removed.
Figure 25:
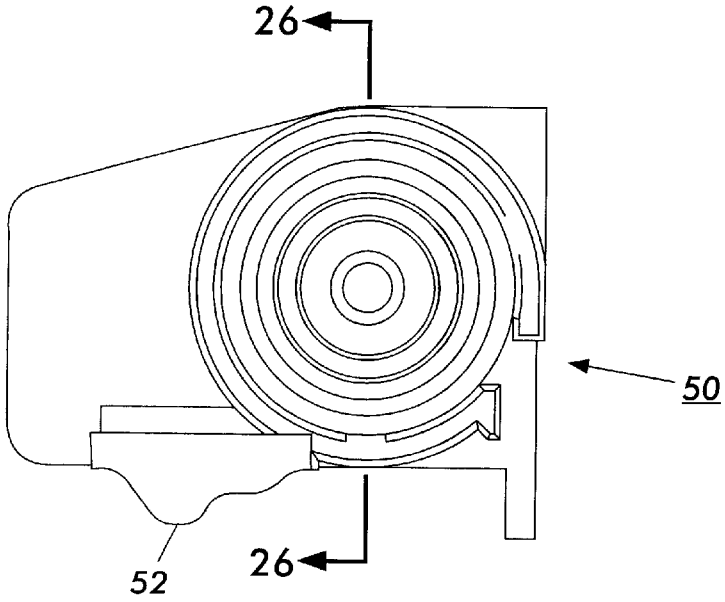
FIG. 25 illustrates a top view of the ink stick pusher of FIG. 24.
Figure 26:
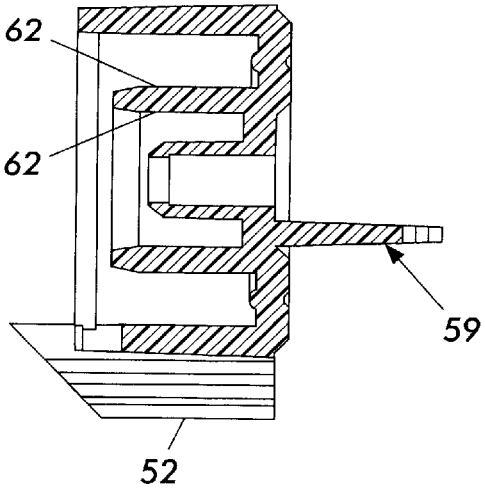
FIG. 26 illustrates a cross-sectional view of the ink stick pusher along line 26—26 of FIG. 25.

FIGS. 24–26 illustrate an exemplary embodiment of an ink stick push block 50 with its hub 53 removed. In the embodiments displayed in FIGS. 24–26, the push block face 52 of an ink stick push block 50 has a contour that complements the contour of the rear surface of ink sticks loaded in a corresponding channel. Because the front and rear surfaces of the ink sticks 2 have a non-planar contour, the face 52 of the ink stick push block 50 illustrated in FIG. 24, for example, also has a non-planar contour. However, the push block face 52 can have any shape that complements the rear surface of an ink stick. For example, if the rear surface were flat, a corresponding push block face would be made flat; if the rear surface had a pattern of depressions, the push block could have a pattern of protrusions that complement the depressions.

In embodiments such as the ones illustrated in FIGS. 23–26, the interface portion of the face 52 of the push block 50 has substantially the same contour as the front surfaces of the ink sticks 2 as well as substantially complementing the rear surfaces of the ink sticks 2. This can occur because the front and rear surfaces of the ink sticks 2 complement each other. However, the front surface of each ink stick need not be the complement of the rear surface of the ink stick. In such embodiments, the front surface of the ink stick push block would not necessarily be the same as the front face of the ink sticks.

When the ink sticks 2 are inserted into the loader, the ink stick push block 50 fits somewhat snugly against the last ink stick in line to be fed to the melt plates 29. In embodiments, to the extent that the face 52 of the ink stick push block 50 protrudes into the space below (breaks a perimeter of) the keyed opening 24 when the ink stick push block 50 is in its rearmost position for ink insertion, the push block face 52 can function as a part of the insertion keying to block insertion of incorrect ink sticks. In such embodiments, the face 52 of the ink stick push block can prevent full insertion of an ink stick unless the rear surface of the ink stick has a contour that complements the contour of the face of the ink stick push block. Such insertion keying by the ink stick push block can be in addition to, or in lieu of, providing a key shape in the section of the perimeter of the opening 24 that is farthest from the melt plate. In embodiments the height of the ink stick is greater than the height of the push block. This allows for keying features in the lower portion of the ink stick that are not present in the upper portion of the ink stick.

The embodiment depicted in FIGS. 24–26 is meant to be exemplary. The face 52 of ink stick push block 50 can be designed to complement a variety of ink stick rear surface contours.

In embodiments, the ink stick push block 50 is further configured to reduce relative motion between itself and the last ink stick, and also to reduce lateral and vertical movement of the push block relative to the feed channel. In embodiments, two offset guide tabs (56, 57) protrude from the bottom of the ink stick push block. Both tabs are narrower than and fit within a guiding slot 58 between a rail and a wall of each of the channels 25. In embodiments, the tabs are located along one edge of the push block 50, thereby allowing part of the underside of the push block 50 to rest on the rail. When the block is loaded against the ink, a torque moment is applied that removes all clearance between the tabs at opposite sides and complementary to positioning the block perpendicular to the line of travel. A guide follower 59 extends downward from the ink stick push block similar to the protruding ink stick guide portion 7 of the ink sticks 2. The guide follower 59 is contoured to at least partially engage with the lower channel ink guide trough 26. This close interface and travel of the guide follower in the lower ink guide trough, tends to keep the guide trough free of ink particles. The guide follower also ensures that the face of the ink stick push block is parallel to the face of the ink such that proper orientation of the ink stick being contacted is maintained.

In embodiments in which the lower channel ink guide 26 is a raised element, such as a raised rail, the push block guide follower 59 can be a recess in the lower portion of the push block body. Such a recessed push block guide follower can also be contoured to at least partially engage the lower channel ink guide portion.

Figure 27:
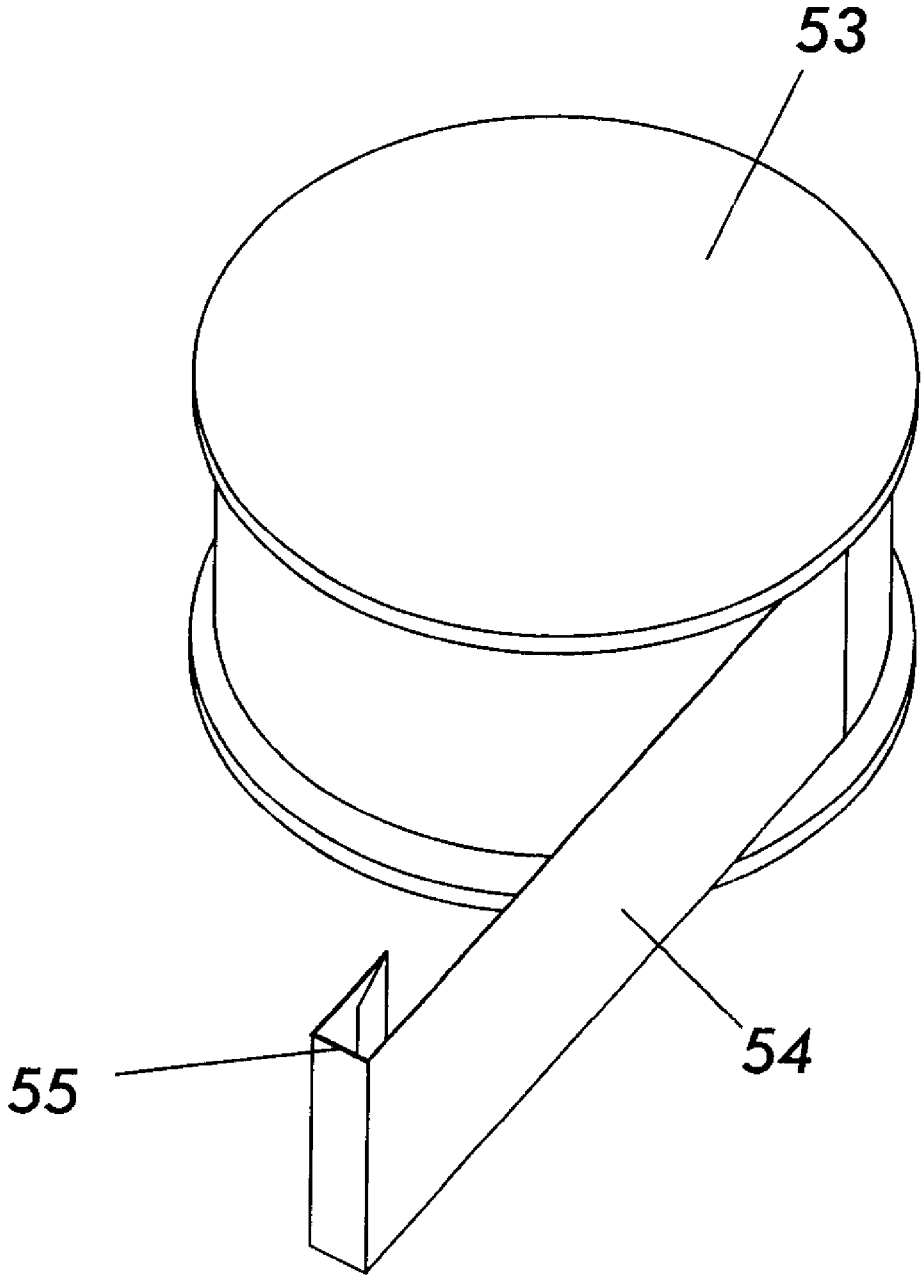
FIG. 27 illustrates a perspective view of an exemplary embodiment of a hub and spring for use with the ink stick pusher of FIGS. 24–26.

FIG. 27 shows an exemplary embodiment of a spring 54 wound onto a hub 53. A first end of each spring 54 is constrained by each hub 53 such that extending or retracting the spring causes the hub to rotate. The spring can be constrained by a variety of methods including, but not limited to, adhesives, a tab and slot configuration, and staking. A second end of each spring 54 anchors to the yoke 17. In embodiments, the spring is a constant force spring. In embodiments, the spring includes a spring attachment clip 55. The clip 55 engages with one of the yoke arms 32 (see FIGS. 17 and 32).

A link and yoke configuration couples the four independent ink stick push blocks 50A–D through the constant force springs 54 to the ink stick feed cover 20. When the yoke 17 and the ink stick push blocks 50 are held apart by intervening ink sticks, the springs 54 extend along the side of the feed channels in which the push blocks are located. The springs 54 apply force in the feed direction on the ink sticks through the push blocks by biasing the faces 52 of the ink stick push blocks 50 against the rear surface contours of the ink sticks. Gaps between the individual key plates 18 provide a path for extended yoke arms 32 to couple to the constant force preload springs 54 (see FIG. 32). In embodiments, to help maintain a straight pull vector on the spring 54, the spring attachment arms 32 extend downward a significant distance. In embodiments, the arms 32 also have an offset shape so that they can clear the sides of the key plates 18 under extended flange 34. The portion of each arm 32 inside the channel is substantially vertical relative to the top of the yoke 17. The arms 32 are spaced far enough from the channel walls to allow springs 54 to pass between the arms and the channel walls.

The use of a spring that extends along the side of a channel helps enable the key plates 18 to have openings 24 that have an unbroken periphery. Some prior art feed assemblies use a preload spring that extends along the top of a channel. For these assemblies, the key plate or the portion of the key plate that extends over the channel would typically have a slot in it that extended for the length of the channel. Such a slot substantially precludes keying features on more than two sides of an opening. However, a preload spring extending along the side of a channel eliminates the need for slots that extend into or beyond the insertion opening of the key plate, thereby helping allow an uninterrupted insertion opening periphery.

In addition to pulling the ink stick push blocks 50A–D forward, side springs 54 also act on the top cover 20 and the load linkage element 30. Lifting the printer ink access cover 20 forces the ink stick push blocks 50 (best seen in FIG. 23) back to a clear position as shown in FIG. 15, thereby allowing ink sticks 2 to be inserted through the keyed insertion openings 24 in the key plates 18 and in front of the push blocks 50. Closing the ink access cover 20 causes the yoke to slide forward causing the spring to pull the push blocks 50 toward the front, which applies a force against the ink sticks 2 causing them to feed toward the melt plates 29 as melting occurs. The cover and linkage design is configured to act as the cover latch by traveling over-center against the spring force in the down position. This design simplifies and speeds ink stick replenishment by automatically providing access to the ink stick insertion openings 24A–D, applying the necessary spring force against the ink sticks 2 and allowing ink sticks of any color to be added regardless of the remaining supply of the other colors simply by opening and closing the cover 20.

Figure 28:
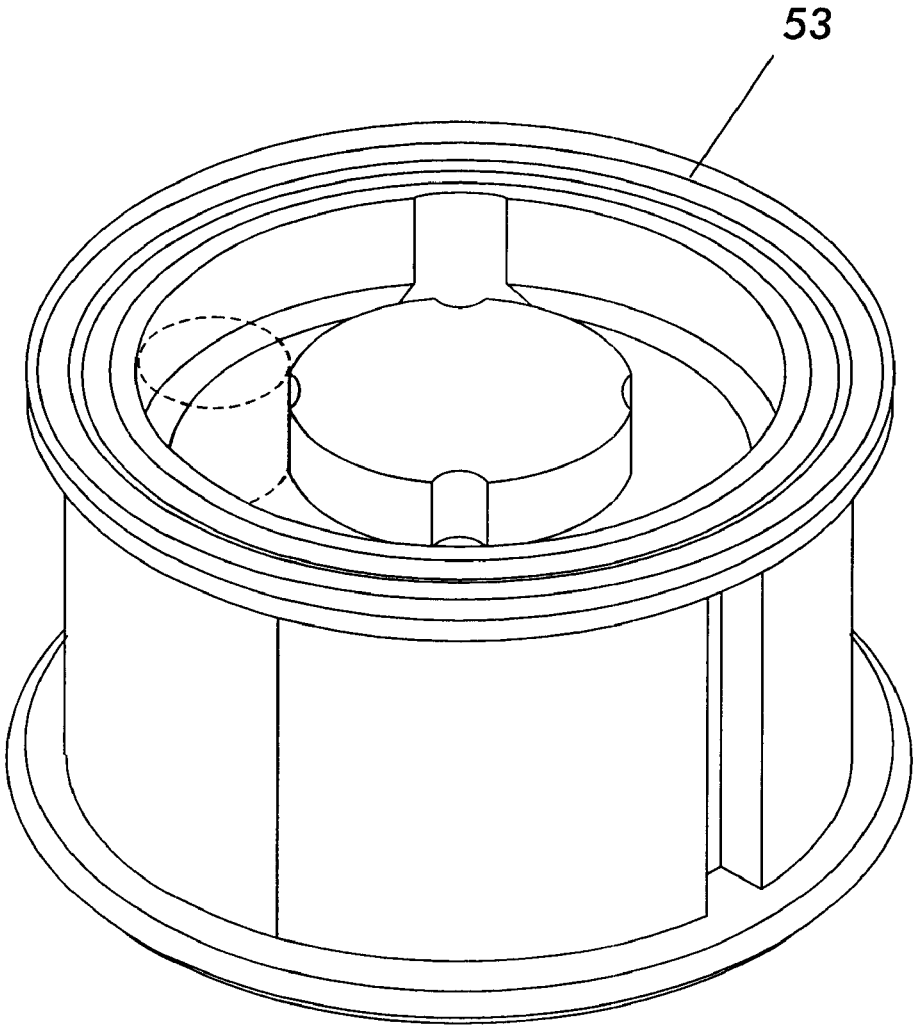
FIG. 28 illustrates a perspective view of an exemplary embodiment of a hub in an inverted position.
Figure 29:
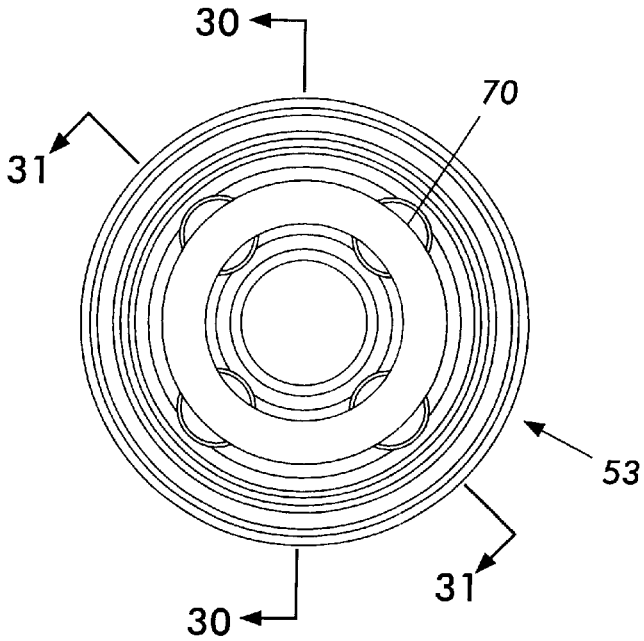
FIG. 29 illustrates a bottom view of the hub of FIG. 28
Figure 30:
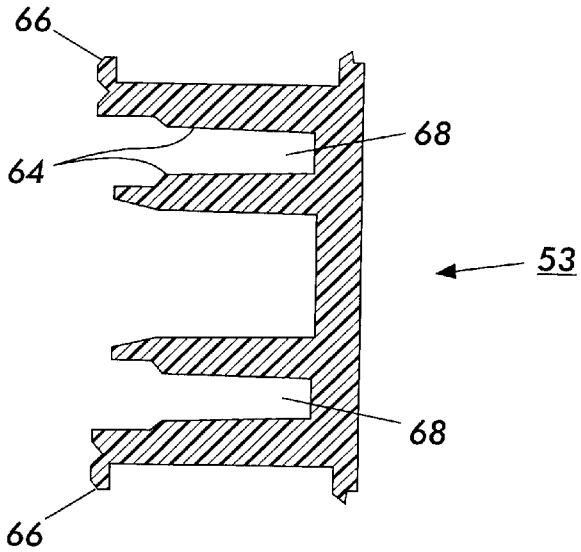
FIG. 30 illustrates a cross-sectional view along line 30—30 of FIG. 29.
Figure 31:
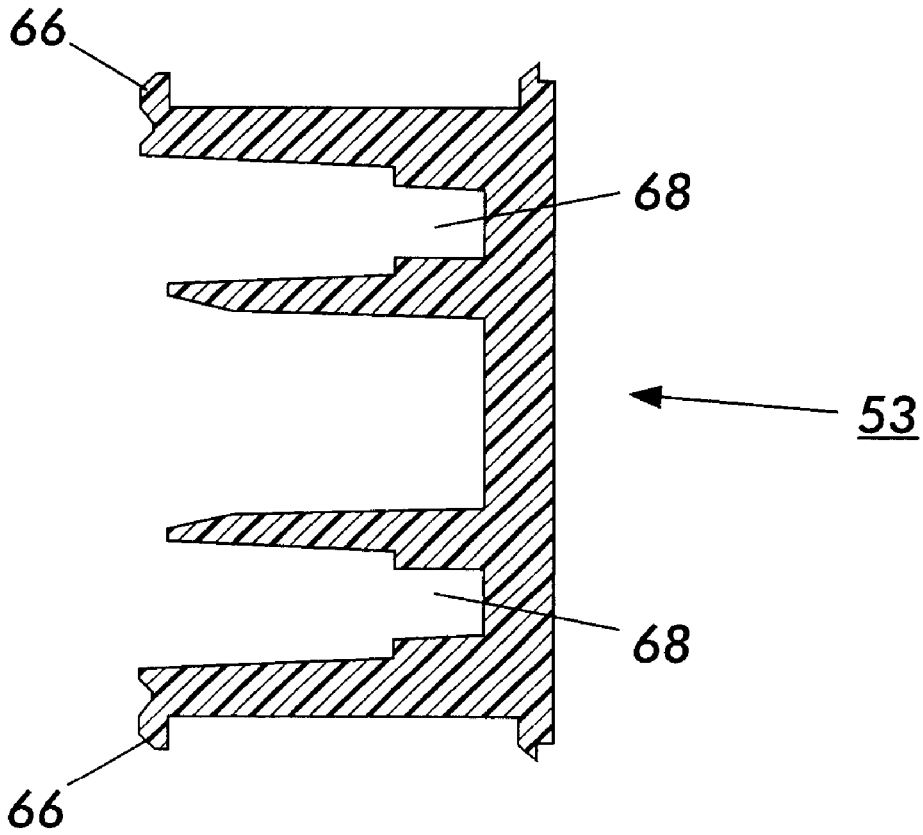
FIG. 31 illustrates a cross-sectional view along line 31—31 of FIG. 29.

FIG. 28 shows an inverted view of an exemplary embodiment of the hub of FIG. 27 with its spring removed. FIG. 29 shows a bottom view of the hub depicted in FIG. 28. FIGS. 30 and 31 illustrate cross-sections through the hub of FIG. 29.

When opening the printer ink access cover 20, the cover 20 can tend to be yanked up very suddenly due to spring force between yoke and push blocks. Friction has been intentionally added to certain parts to achieve some control over this motion of the cover 20. Friction is relied upon to impart a smooth controlled feeling to the motion of the printer cover 20 and helps to keep the cover 20 from opening too quickly.

When a loader is full, the ink preload springs 54 exert a force on the yoke 17 that causes it to slide almost all the way to its rearmost rear position as the ink access cover is opened. This force can cause the door to open with excessive speed, which in turn may cause damage to the printer including possible damage to the hub and push block. This is in part because each hub 53 can rotate freely within the push blocks 50. In embodiments, to help prevent the sudden opening of the access cover, damping grease can be added to the small gap between walls of the hub 53 and the ink stick push block 50 to increase the friction between the two components.

Since the spring establishes the force, a beneficial place to apply a dampening effect is at the interface of the spring hub to the ink stick push block body. Each hub has four needle holes 70 to facilitate the injection of a grease into the hub 53. In embodiments, the hub 53 is then inverted and placed over the ink stick push block 50 and the grease disperses between the walls 64 of the hub 53 and the walls 62 of the ink stick push block 50. The interface surfaces are internal to the spring hub, away from the spring itself to prevent contamination of the ink or loader with grease. To help distribute the grease substantially uniformly, the springs 54 can be extended and retracted one or more times.

The grease is applied to internal walls of both the hub and push block. The hub to ink stick push block damping interface is provided with damping fluid displacement and expansion volume between components so that excess grease can be accommodated and captured. The interface provides a slight gap between components and is truncated with respect to the overall height so that an area 68 is created that accepts excess grease and captures it. In this way, the grease volume variation that results from variations in the parts and assembly process can be accommodated by applying slightly more grease than is necessary to fill the nominal gap, helping to ensure that the unit always has the appropriate amount of grease for optimal performance.

Figure 32:
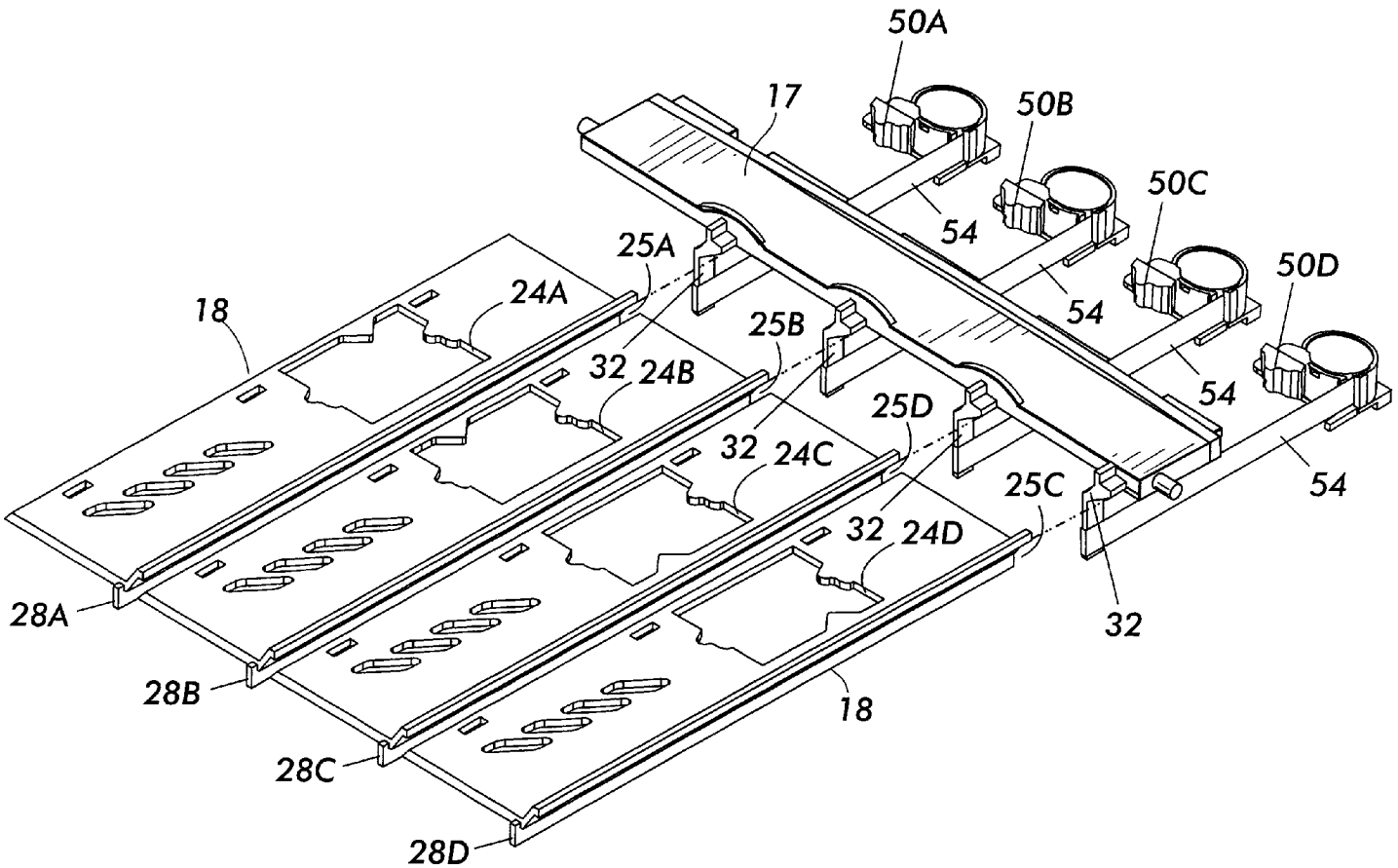
FIG. 32 is an exploded view of a portion of the assembly of FIG. 7 showing the bail and yoke assembly and the side spring arrangement that advances the ink stick pusher blocks into contact with the individual ink sticks.

To help illustrate the arrangement of components in the present loader 16, FIG. 32 shows an exploded view emphasizing the yoke and the side spring arrangement that advances the ink stick push blocks into contact with the individual ink sticks (not shown).

Referring now to FIGS. 16, 17, and 33–35, an ink level sensing configuration uses a flag system having a single flag vane 88 to detect particular ink quantity conditions, such as both ink low and ink out conditions. The ink level sensing configuration is positioned along the feed channel so that a single element identifies two or more ink quantity conditions. In embodiments, as the position of the push block 50 (which follows the last ink stick in the feed channel) passes particular points in the feed channel, the push block triggers the sensing configuration to detect the quantity of ink in the feed channel. In the embodiment illustrated, the ink level sensor is activated by the first of the plural ink supply feed channels to reach the designated ink level condition. Once a "low ink" or "empty ink" supply status is detected for any of the feed channels, the printer can be programmed to display a message to the user on the front panel display screen 31. The user then is expected to open the ink access cover 20 to replenish the feed channel with the low ink or empty status. With the printer's ink access cover open, the printer user can physically observe the status of the other ink feed channels, and add ink if necessary.

In embodiments, the ink level sensing configuration includes a central bar or span 80, pivoting arms 82 with attachment features 84 and actuation tabs 86 interfacing with the chute 9. The arms 82 extend upward in the spaces between channels. The arms 82 split forming the attachment features 84 on the ends. The protruding attachment features 84 couple the arms 82 (and therefore the span 80) to the chute 9. Each of the actuation tabs 86 extends into the push block guide slot 58 in each channel 25A–D. A flag vane 88 for triggering the sensors extends from the span 80. In embodiments, an extension spring 90 is connected to one end of the flag vane 88. The other end of the spring 90 is attached to the chute 9. The spring 90 biases the flag vane 88 toward the rear of the chute 9.

In embodiments (such as those illustrated in FIGS. 16, 17, and 33–35) the ink level sensing system uses optical sensors 39 and 40. In embodiments, these sensors are optical interrupter sensors. The sensors 39, 40 detect ink quantity status conditions, such as a "low ink" supply status and an "empty ink" supply status. Typical sensors that could be used, for example, are the Model J45 photointerrupter sensors from Omron Electronics, Inc. of Schaumburg, Ill. These sensors have an LED transmitting a signal and a phototransistor that detects the signal from the LED. Apertures over the opposing optical devices enable the sensor to sense when any opaque material interrupts the signal between the LED and the phototransistor.

In alternative embodiments, the sensing can be performed by electrical contacts engaged by the moving flag. The sensors 39, 40 could simply constitute open electrical switches that a metal flag vane closes when it passes between the circuit elements. The sensors could also constitute simple mechanical switches, which the flag vane triggers as it passes by.

The sensors 39 and 40 are located on an electronic circuit board (ECB) 96. The ECB 96 provides electrical interface connections to the melt plates and sensors. It mounts to the underside of the loader by first attaching to a shield, which then couples to the channel with snap fit features.

Figure 33:
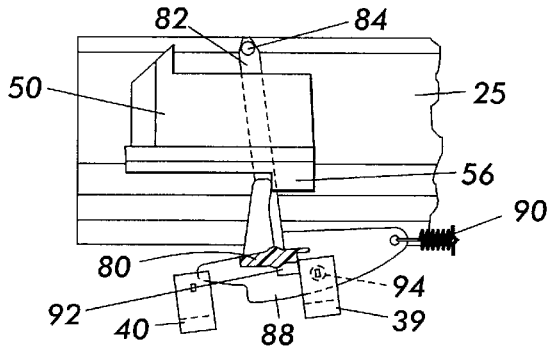
FIG. 33 is a schematic view of an embodiment of the flag system when the ink quantity is at a first level.

While the flag is in its first or normal status position, (i.e., when the ink quantity is at a first, or normal level, before a low ink supply status is reached in any of the channels 25A–D), the extension spring 90 holds the flag vane 88 in its first or normal status position by exerting a substantially constant force on the flag vane 88 towards the rear of the ink stick loader 9. In embodiments where the sensors 39 and 40 are optical sensors, the vane's travel in the rearward direction is limited by contact between tabs 92 and the sensor 39. In this "normal" position, a hole 94 in flag vane 88 substantially aligns with the optical path between the LED and the phototransistor of sensor 39 as shown in FIG. 33.

Figure 34:
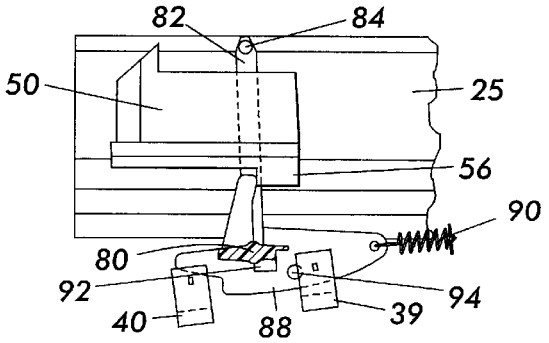
FIG. 34 is a schematic view of an embodiment of the flag system when the ink quantity is at a second level.

The guide tab portion 56 of each ink stick push block 50 extends into the push block guide slot 58 at the side of each channel. In a channel where the ink stick level falls below a certain predetermined point, indicating that the ink quantity in the channel has reached a particular level, the ink stick push block guide tab 56 (see FIG. 23) in that channel contacts one of the actuation tabs 86, thereby pushing it forward. As one of the push block guide tabs 56 moves one of the actuation tabs 86 forward, the span 80 pivots forward, thereby moving the flag vane 88 forward. After the span moves a short distance forward (~1 mm), the flag vane 88 will have moved far enough so that the hole 94 is no longer aligned with the optical path between the LED and the phototransistor of sensor 39, as shown in FIG. 34. The flag vane 88 now blocks the optical path, causing a change in the phototransistor. This change in the status of the phototransistor triggers an indication of low ink status, which can be indicated to the user through a variety of methods. In embodiments, this information can be communicated across the display screen 31. For example, the message might be "ink low." In embodiments, the distance between the normal status position and a position that triggers a low ink status ranges from approximately 0.5 mm to approximately 1.5 mm. Range is dependent upon in part due to circuit board, sensor, and part tolerances.

Figure 35:
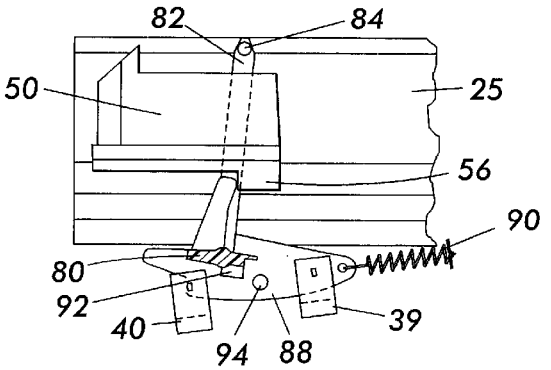
FIG. 35 is a schematic view of an embodiment of the flag system when the ink quantity is at a third level.

As the ink stick push blocks 50 continue to move forward, the forwardmost actuation tab located in the channel with the least remaining volume of ink continues to be pushed forward. Eventually, when the push block in one of the feed channels has traveled far enough along the feed direction of the feed channel toward the melt plate, indicating that the ink quantity has reached a third level, a portion of the flag vane 88 will eventually block the optical path between the LED and phototransistor of the second sensor 40 as shown in FIG. 35. This triggers a second ink level status, such as an "out of ink" status indication. In embodiments, this information can be communicated across the display screen 31. An out of ink status, such as, for example, "ink empty" can be displayed on the display screen 31. In embodiments, the printer also can be programmed to stop printing when the ink level in one of the channels reaches the "out of ink" status, to avoid damaging the printer. In embodiments, the distance between a low ink status and an out of ink status ranges from approximately 4 mm to approximately 7 mm.

As other colors of ink are used after one color reaches the "ink low" point, they will not affect the displayed ink supply status unless the second color to reach ink low status, reaches ink out status before the first color. Once the single flag vane 88 is in an ink low position, the ink supply status on the panel message window will not change until one of the ink supplies drops below the "ink out" threshold. In embodiments, once one of the ink channels is depleted enough, the "ink low" supply status signal displayed on the front panel message window 31 will change to an "ink empty" or similar message.

Actuation of the ink level flag system is facilitated by its interface with the push block guide tabs 56, 57. The front push block guide tab 57 is shallow and will not contact actuation tabs 86, while the rear tab 56 extends deeper into the guiding slot, allowing it to actuate the ink level flag through a range that extends to the limits of ink stick push block forward travel. Those skilled in the art will recognize, given the above teaching, how to alter the relative placement of the sensors 39, 40, and the geometry of the flag vane 88 to vary the amount of push block travel between the different ink levels sensed by the sensors.

Figure 36:
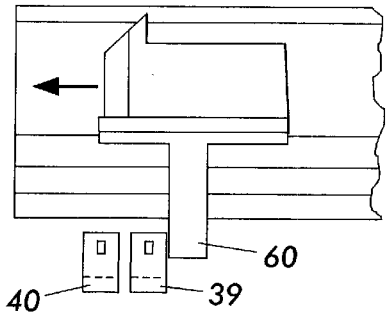
FIG. 36 is a schematic view of the another embodiment of flag system when the ink quantity is at a first level.
Figure 37:
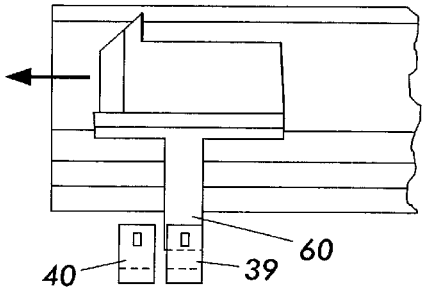
FIG. 37 is a schematic view of another embodiment of the flag system when the ink quantity is at a second level.
Figure 38:
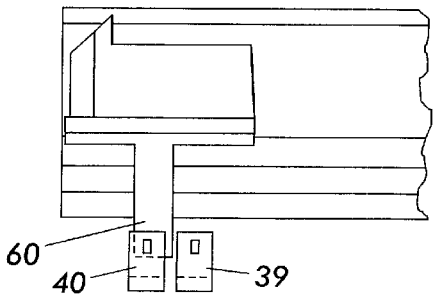
FIG. 38 is a schematic view of another embodiment of the flag system when the ink quantity is at a third level.

In other embodiments, the sensors can be activated by an extension of the push block itself, rather than a separate flag system element. See FIGS. 36–38. Each push block 50 would have an arm 60 that would extend downward through one side of the channel or in the space between channels. In this embodiment, each channel of the chute would have a corresponding own pair of sensors 39, 40. These would detect the arm 60 of the push block as it passed by.

Figure 39:
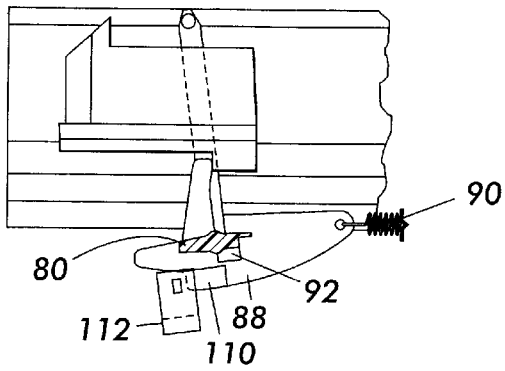
FIG. 39 is a schematic view of yet another embodiment of the flag system when the ink quantity is at a first level.
Figure 40:
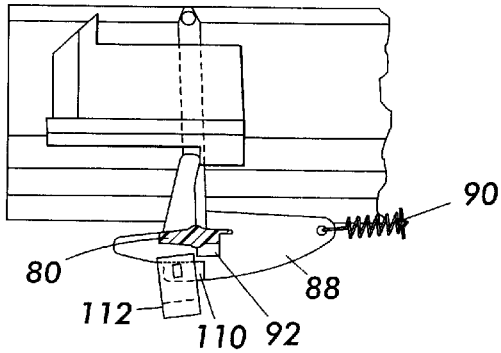
FIG. 40 is a schematic view of yet another embodiment of the flag system when the ink quantity is at a second level.
Figure 41:
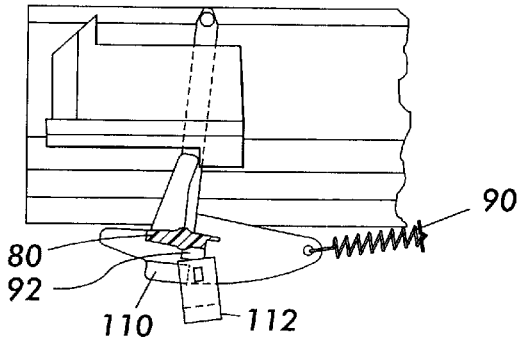
FIG. 41 is a schematic view of yet another embodiment of the flag system when the ink quantity is at a third level.

In still other embodiments, a single flag and a single optical sensor can be used. In the embodiment shown in FIGS. 39–41, the flag vane 88 includes a translucent portion 110. An optical sensor 112 similar to the sensors 39, 40 used in the embodiments of FIGS. 33–35 can be used. However, one significant difference would be that the sensor 112 can distinguish based upon signal strength. When the translucent portion of the flag moves between the emitter and receiver of the sensor 112, the lowered optical signal measured by the receiver triggers an indication of low ink status. See FIG. 40. Once the opaque portion of the flag vane 88 moves between the emitter and receiver, a second ink level status is triggered, such as an "out of ink" status indication. See FIG. 41. This flag system can be moved by the push blocks 50 as discussed in the preceding description.

While the present invention has been described concerning specific embodiments thereof, it will be understood that it is not intended to limit the invention to these embodiments. It is intended to encompass alternatives, modifications, and equivalents, including substantial equivalents, similar equivalents, and the like as may be included within the spirit and scope of the invention as defined by the appended claims.

What is claimed:

1. A solid ink loader for feeding solid ink sticks in a phase change ink jet printer, comprising:

a feed chute with at least one feed channel for receiving at least one ink stick;

a push block having at least one push block wall located inside the at least one feed channel, a hub having at least one internal hub wall, wherein the at least one internal hub wall is situated concentric with the at least one push block wall, and wherein the hub can rotate substantially freely relative to the push block;

a damping fluid located between the at least one internal hub wall and the at least one push block wall for substantially increasing the friction between the hub and the push block.

2. The loader of claim 1, further comprising a key plate for the at least one feed channel, the key plate having a insertion opening corresponding to one of a plurality of distinctive ink stick shapes.

3. The loader of claim 1, wherein the hub walls and the push block walls are substantially cylindrical.

4. The loader of claim 1, further comprising a spring constrained by the hub.

5. The loader of claim 4, wherein the spring is a constant force spring.

6. The loader of claim 5, wherein the spring winds about the hub.

7. An ink stick push block, comprising:

a push block body having a wall;

a hub having a wall, wherein the hub is assembled to said push block such that the wall of the push block body fits substantially adjacent the wall of the hub, and wherein the hub can rotate substantially freely about the push block wall; and a fluid located between the push block wall and the hub wall.

8. The push block of claim 7, wherein the push block wall and the hub wall are roughly cylindrical.

9. The push block of claim 7, further comprising a spring attached to the hub.

10. The push block of claim 9, wherein the spring is a constant force spring.

11. The push block of claim 10, wherein the spring winds about the central hub.

12. A solid ink loader for feeding solid ink sticks in a phase change ink printer, the feed system comprising:

a first feed channel for receiving of a plurality of ink sticks, the first feed channel having a bottom surface and at least one side surface having a recessed portion that is recessed with respect to the remainder of the side surface;

a first push block having at least one cylindrical push block wall and a spring hub having at least one concentric hub wall such that the at least one hub wall can rotate freely with respect to the at least one push block wall;

a viscous fluid located between the at least one hub wall and the at least one push block wall;

wherein an interface of the at least one hub wall and the at least one push block wall additionally provides a volume to accept excess viscous fluid;

a yoke;

a first spring connecting the yoke to the first push block, wherein the first spring extends along the recessed portion of the side surface of the first feed chute.

13. The loader of claim 12, wherein the first spring is a constant force spring.

14. The loader of claim 12, wherein the first spring is a coil spring.

15. The loader of claim 12, further comprising a key plate for the first feed channel, the key plate having a insertion opening corresponding to one of a plurality of distinctive ink stick shapes.

16. An ink stick push block, comprising:

a push block body;

a hub, wherein the hub is assembled to said push block body such that the hub can rotate substantially freely about the push block;

a fluid located between the hub and the push block body to alter the friction between the hub and the push block.

17. The push block of claim 13, wherein the push block wall and the hub wall are roughly cylindrical.

18. The push block of claim 13, further comprising a spring attached to the hub.

19. The push block of claim 18, wherein the spring is a constant force spring.

20. The push block of claim 19, wherein the spring winds about the central hub.

* * * * *